US012031382B2

(12) United States Patent
Butt et al.

(10) Patent No.: US 12,031,382 B2
(45) Date of Patent: Jul. 9, 2024

(54) METHOD AND SYSTEM FOR MINING

(71) Applicant: NOVAMERA INC., Oakville (CA)

(72) Inventors: Stephen Douglas Butt, St. John's (CA); Allan R. Cramm, Baie Verte (CA); Jeronimo De Moura Junior, St. John's (CA); Mohammed Mokhtar Ebeid Said, Paradise (CA)

(73) Assignee: Novamera Inc., Oakville (CA)

( * ) Notice: Subject to any disclaimer, the term of this patent is extended or adjusted under 35 U.S.C. 154(b) by 163 days.

(21) Appl. No.: 17/433,551

(22) PCT Filed: Nov. 29, 2019

(86) PCT No.: PCT/CA2019/051720

§ 371 (c)(1),
(2) Date: Aug. 24, 2021

(87) PCT Pub. No.: WO2020/172736

PCT Pub. Date: Sep. 3, 2020

(65) Prior Publication Data

US 2022/0154567 A1 May 19, 2022

Related U.S. Application Data

(60) Provisional application No. 62/810,818, filed on Feb. 26, 2019.

(51) Int. Cl.
*E21B 10/32* (2006.01)
*E21B 7/28* (2006.01)
(Continued)

(52) U.S. Cl.
CPC ..... *E21B 10/32* (2013.01); *E21B 7/28* (2013.01); *E21B 21/065* (2013.01); *E21B 43/29* (2013.01);
(Continued)

(58) Field of Classification Search
CPC . E21B 43/29; E21B 7/28; E21B 10/32; E21B 21/065; E21B 47/002; E21B 7/06;
(Continued)

(56) References Cited

U.S. PATENT DOCUMENTS 1,169,369 A * 1/1916 Wakfer ..... E21B 10/40 175/395
2,540,464 A 2/1951 Stokes
(Continued)

FOREIGN PATENT DOCUMENTS

WO 2015030808 A1 3/2015
WO 2016073436 A1 5/2016

OTHER PUBLICATIONS

International Search Report, PCT/CA2019/051720, ISA/CA, Jan. 30, 2020.

(Continued)

*Primary Examiner* — Nicole Coy
(74) *Attorney, Agent, or Firm* — Law Offices of Nisan Steinberg

(57) ABSTRACT

A method for mining narrow vein deposit of ore, the narrow vein deposit having a hanging wall and a foot wall, the method comprising: drilling a pilot hole into the narrow vein deposit along a path substantially centrally between the hanging wall and the foot wall to a depth within the vein; following the pilot hole with a larger diameter drilling assembly to fragment the ore into drill cuttings; circulating the drill cuttings to a wellhead; and collecting the drill cuttings for processing to recover the ore therefrom.

29 Claims, 17 Drawing Sheets

(51) Int. Cl.

| | |
|---|---|
| ***E21B 21/06*** | (2006.01) |
| ***E21B 43/29*** | (2006.01) |
| ***E21B 47/002*** | (2012.01) |
| ***E21C 27/22*** | (2006.01) |
| ***E21C 41/26*** | (2006.01) |

(52) U.S. Cl.
CPC ..... *E21B 47/002* (2020.05); *E21B 47/0025* (2020.05); *E21C 27/22* (2013.01); *E21C 41/26* (2013.01)

(58) Field of Classification Search
CPC .... E21B 43/122; E21B 47/0025; E21C 27/22; E21C 41/26; E21C 29/22
See application file for complete search history.

(56) References Cited

U.S. PATENT DOCUMENTS

| | | | | | |
|---|---|---|---|---|---|
| 2,688,463 | A | * | 9/1954 | Bettes | E21B 7/065 175/344 |
| 3,399,738 | A | * | 9/1968 | Haspert | E21B 7/28 175/320 |
| 3,718,930 | A | | 2/1973 | Mccullough et al. | |
| 3,737,037 | A | * | 6/1973 | Bone, III | E21B 21/065 210/734 |
| 3,758,160 | A | | 9/1973 | Hilton | |
| 3,823,787 | A | * | 7/1974 | Haworth | E21B 47/022 340/854.6 |
| 4,003,017 | A | | 1/1977 | Bailey | |
| 4,280,732 | A | | 7/1981 | Haspert | |
| 4,399,692 | A | | 8/1983 | Hulsing, II et al. | |
| 4,448,267 | A | * | 5/1984 | Crawford, III | E21B 17/00 175/218 |
| 4,532,544 | A | | 7/1985 | Federau | |
| 4,693,328 | A | * | 9/1987 | Furse | E21B 10/34 175/275 |
| 4,779,201 | A | | 10/1988 | Iizuka et al. | |
| 5,325,714 | A | | 7/1994 | Lende et al. | |
| 5,652,617 | A | | 7/1997 | Barbour | |
| 5,984,011 | A | | 11/1999 | Misselbrook et al. | |
| 6,162,284 | A | * | 12/2000 | Mitchell | B01D 21/283 96/195 |
| 6,349,778 | B1 | | 2/2002 | Blair et al. | |
| 6,886,644 | B2 | | 5/2005 | Stump et al. | |
| 7,004,263 | B2 | | 2/2006 | Moriarty et al. | |
| 7,513,318 | B2 | | 4/2009 | Underwood et al. | |
| 9,045,950 | B2 | * | 6/2015 | O'Reilly | E21B 7/025 |
| 9,810,058 | B2 | | 11/2017 | Frantzen et al. | |
| 10,858,929 | B2 | | 12/2020 | Estes et al. | |
| 2002/0053471 | A1 | | 5/2002 | Blair et al. | |
| 2004/0104051 | A1 | | 6/2004 | Moriarty et al. | |
| 2006/0113113 | A1 | | 6/2006 | Underwood et al. | |
| 2006/0149477 | A1 | | 7/2006 | Cairns et al. | |
| 2014/0102799 | A1 | | 4/2014 | Stringer et al. | |
| 2016/0123096 | A1 | | 5/2016 | Mathieson et al. | |
| 2016/0370491 | A1 | | 12/2016 | Fechine et al. | |
| 2017/0138173 | A1 | | 5/2017 | Estes et al. | |
| 2019/0186207 | A1 | | 6/2019 | Hudson et al. | |

OTHER PUBLICATIONS

Creamer, Martin, "Revolutionary gold-mining machine making progress-AngloGold," downloaded Oct. 10, 2019 from: www.miningweekly.com/article/revolutionary-gold-mining-machine-making-progress-anglogold-2016-08-15 (Aug. 15, 2016).

Hoefinghoff, Jan-Florian et al., "Resistive Loaded Antenna for Ground Penetrating Radar Inside a Bottom Hole Assembly," IEEE Transactions on Antennas and Propagation, vol. 61, No. 12, pp. 6201-6205, Dec. 2013.

* cited by examiner

METHOD AND SYSTEM FOR MINING

This is a U.S. national phase application under 35 U.S.C. § 371 of United States Patent Cooperation Treaty Application No. PCT/CA2019/051720, filed Nov. 29, 2019, which claims priority from U.S. Provisional Patent Application Ser. No. 62/810,818, filed in the United States Patent and Trademark Office on Feb. 26, 2019, and this national phase application incorporates by reference those PCT and Provisional applications in their entireties.

FIELD

This invention relates to methods and systems for mining and in particular methods and systems for mining narrow vein deposits.

BACKGROUND

Narrow vein deposits are challenging to mine. Narrow veins are generally considered to have a thickness of 3 meters or less between the hanging wall and the foot wall. In some deposits, there are veins of valuable ores such as gold where they are not only narrow but also steeply dipping. These deposits become stranded because there is no effective way of mining them. Neither open pit methods nor underground cut and fill methods are economically viable for mining a steeply dipping ore vein and such methods, in fact, often would result in a net loss. The environmental impacts of these approaches are also unattractive.

That being said, just within the province of Newfoundland, Canada, there are an estimated 3.4 million ounces of gold resources that occur within these narrow steeply dipping ore veins.

SUMMARY OF THE INVENTION

In accordance with a broad aspect of the present invention, there is provided a method for mining narrow vein deposit of ore, the narrow vein deposit having a hanging wall and a foot wall, the method comprising: drilling a pilot hole into the narrow vein deposit along a path substantially centrally between the hanging wall and the foot wall to a depth within the vein; following the pilot hole with a larger diameter drilling assembly to fragment the ore around the pilot hole into drill cuttings; circulating the drill cuttings with a fluid flow up to a wellhead; and collecting the drill cuttings for processing to recover the ore therefrom.

In accordance with another broad aspect of the present invention, there is provided a mining system for mining a narrow vein deposit of ore, the system comprising: a drilling rig; a pilot hole drilling assembly including a drill head for drilling a pilot hole in the ore, a downhole survey tool for locating a hanging wall and a foot wall of the narrow vein deposit relative to the pilot hole and a directional assembly for directing the drill head along a path between the hanging wall and the foot wall; a hole opener assembly including an end configured to follow the pilot hole and a hole opener drill configured to drill a borehole with a larger diameter than the pilot hole to fragment the ore into drill cuttings; a fluid circulation subsystem to move a fluid through the well to circulate the drill cuttings from the borehole to a well head.

It is to be understood that other aspects of the present invention will become readily apparent to those skilled in the art from the following detailed description, wherein various embodiments of the invention are shown and described by way of example. As will be realized, the invention is capable for other and different embodiments and several details of its design and implementation are capable of modification in various other respects, all captured by the present claims. Accordingly, the detailed description and examples are to be regarded as illustrative in nature and not as restrictive.

DESCRIPTION OF THE FIGURES

For a better appreciation of the invention, Figures are appended as follows.

DETAILED DESCRIPTION

The detailed description and examples set forth below are intended as a description of various embodiments of the present invention and are not intended to represent the only embodiments contemplated by the inventor. The detailed description includes specific details for the purpose of providing a comprehensive understanding of the present invention. However, it will be apparent to those skilled in the art that the present invention may be practiced without these specific details.

Narrow vein deposits typically have thicknesses of less than 3 meters (usually about 1-2 meters) between their hanging and foot walls. Narrow veins can be steeply sloped, such as dipping from 45-90°, or most often 60-85° relative to horizontal. They can be accessed from an access location, such as on or near surface or in an underground location such as in a mine shaft.

This method for mining includes: drilling a pilot hole from the access location down into the narrow vein deposit and along a path substantially centrally between the hanging wall and the foot wall to a depth within the vein; following the pilot hole with a larger diameter drilling assembly to fragment the ore into drill cuttings; circulating the drill cuttings with drilling fluid circulation up to the access location; and collecting the drill cuttings for processing to recover the ore therefrom.

From a sustainable mining perspective, the method offers one or more advantages over conventional methods such as:

Improved safety—an access location can be selected that is as close as possible to the upper end of the vein, such as at or near surface or in a mine where the vein is exposed and extends down therefrom. Since all operations can be conducted from an established access location above the vein, this method eliminates the risks associated with cave ins. Since there are many veins of interest that can be accessed from surface, exposure of workers to underground mining can be avoided altogether. The entire mining operation can be conducted from surface and there is no reason to have workers underground.

Minimizing the environmental footprint—the method has a minimal surface area requirement during mining and the borehole can be readily reclaimed. As well, the method may include borehole backfilling as part of the mining cycle, which can reduce surface tailings storage requirements.

Improved mining and energy efficiency—no blasting is required and the method can be highly selective with minimal dilution. Since the ore is retrieved as drill cuttings, the usual step of crushing is mostly eliminated. Most equipment can be powered by electricity. Overall, this means less energy consumption and fewer emissions per unit of ore produced.

Figure 1A:
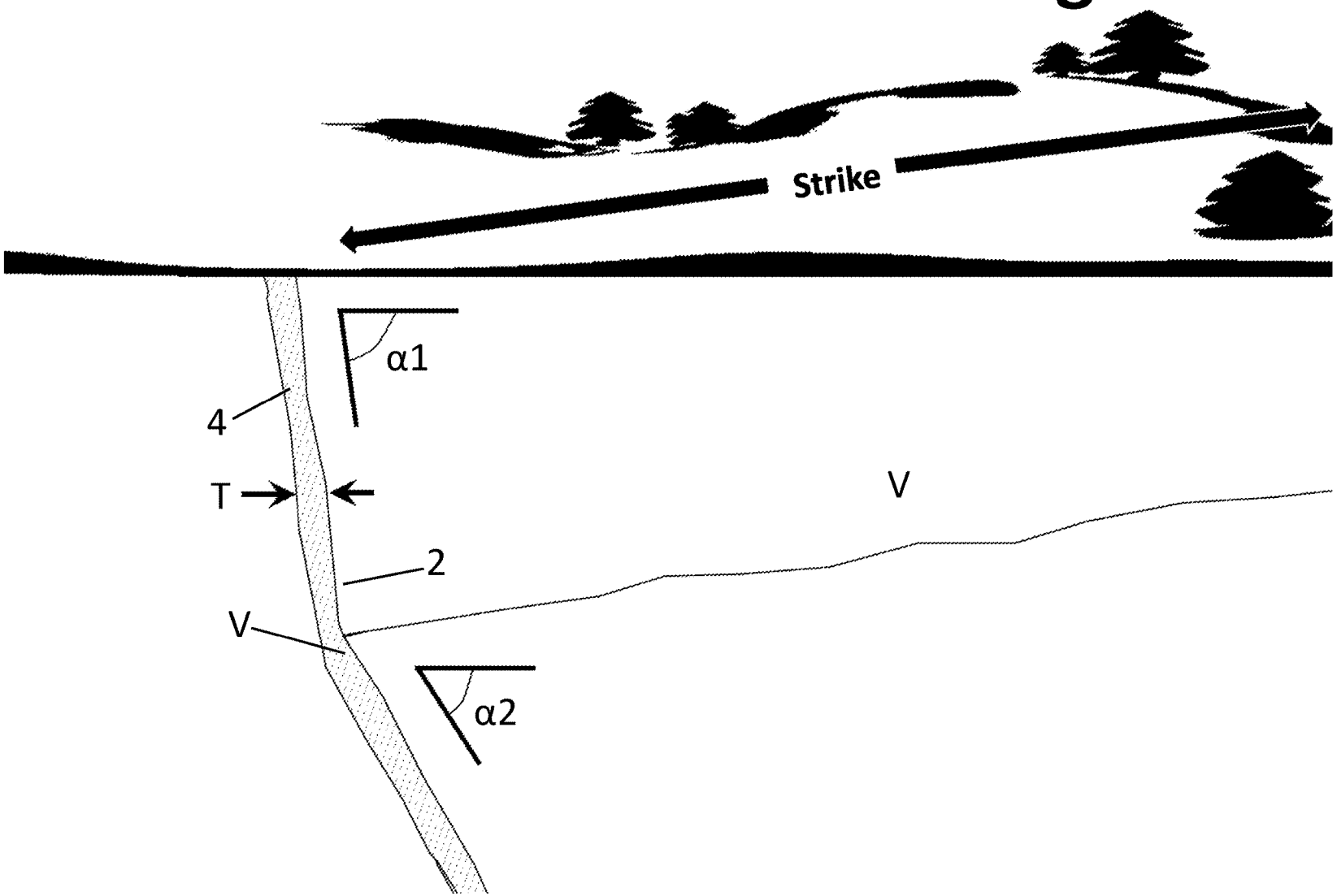
FIGS. 1A to 1G are a series of schematic drawings that show the steps in a mining method and illustrate a possible mining system and aspects thereof.
Figure 1B:
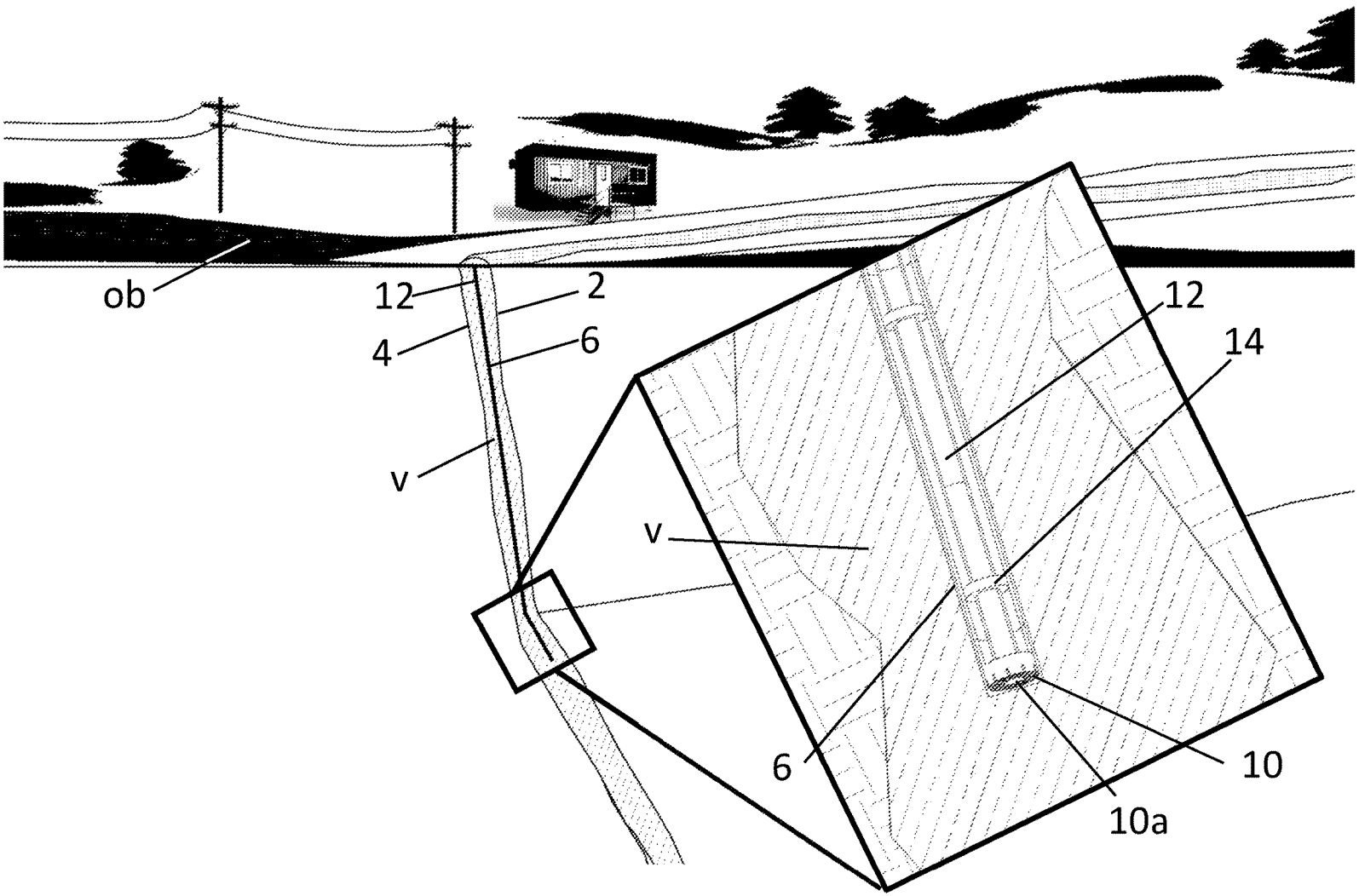

With reference to FIGS. 1A to 1G, the new mining method is intended to mine stranded, narrow and possibly steeply dipping ore veins that are too small or isolated to be mined economically using conventional methods. An example of such a vein v is shown in FIG. 1A. Such an ore vein v has a strike length, such as typically of 100-300 metres, and a thickness T of less than 3 meters, for example typically about 1-2 meters, between its hanging wall 2 and foot wall 4. The thickness T can vary along the depth and the strike length of the vein.

Narrow vein deposit v can be steeply sloped, such as dipping at an angle of from 45-90°, or most often 60-85° relative to horizontal. The vein can have a dipping angle that varies along its depth, for example being at an angle $\alpha$1 near the upper end, which changes to $\alpha$2 at a greater depth.

The vein can be accessed from an access location above the vein, such as on or near surface s. While an access location on surface is preferred, this mining method could also be conducted from an exposed vein deposit in a mine shaft that intersects the vein.

The mining method is a two-stage method that can be summarized as mining-by-drilling.

In the first stage (FIGS. 1B and 1C), if necessary, the site is prepared such as by removing any overburden ob to access the vein's upper end. Thereafter, a pilot hole 6 is drilled from the access location down into the depth of the vein v between the hanging wall 2 and the foot wall 4 using drilling assembly including a pilot bit 10 on a drill string 12. Directional drilling tools 14 and methods and downhole survey tools 16 and methods may be used to maintain the pilot hole within the vein along its depth and to map the vein. Non-destructive survey methods may be used to determine vein trajectory and the distance from the pilot hole to the hanging wall and foot wall. As such, pilot bit 10 can drill down while remaining substantially centered between the hanging wall and the foot wall without side tracking beyond the margins of the ore deposit into the over and under lying waste rock. At the same time, the vein can be characterized such as including its dip angles and thickness.

The non-destructive survey may including near bore imaging technologies. The survey and imaging may be conducted at least at regular intervals. Thus, from time to time while drilling the pilot hole, a downhole survey may be undertaken. In one embodiment, an imaging and survey tool such as a wireline survey and/or geophysical tool, measures the borehole trajectory and the location and geometry of the vein near the borehole and about the bit. The pilot hole trajectory is then changed, as needed, to follow the dip and stay within the vein, for example, substantially midway between the hanging wall and foot wall contacts.

Figure 1C:
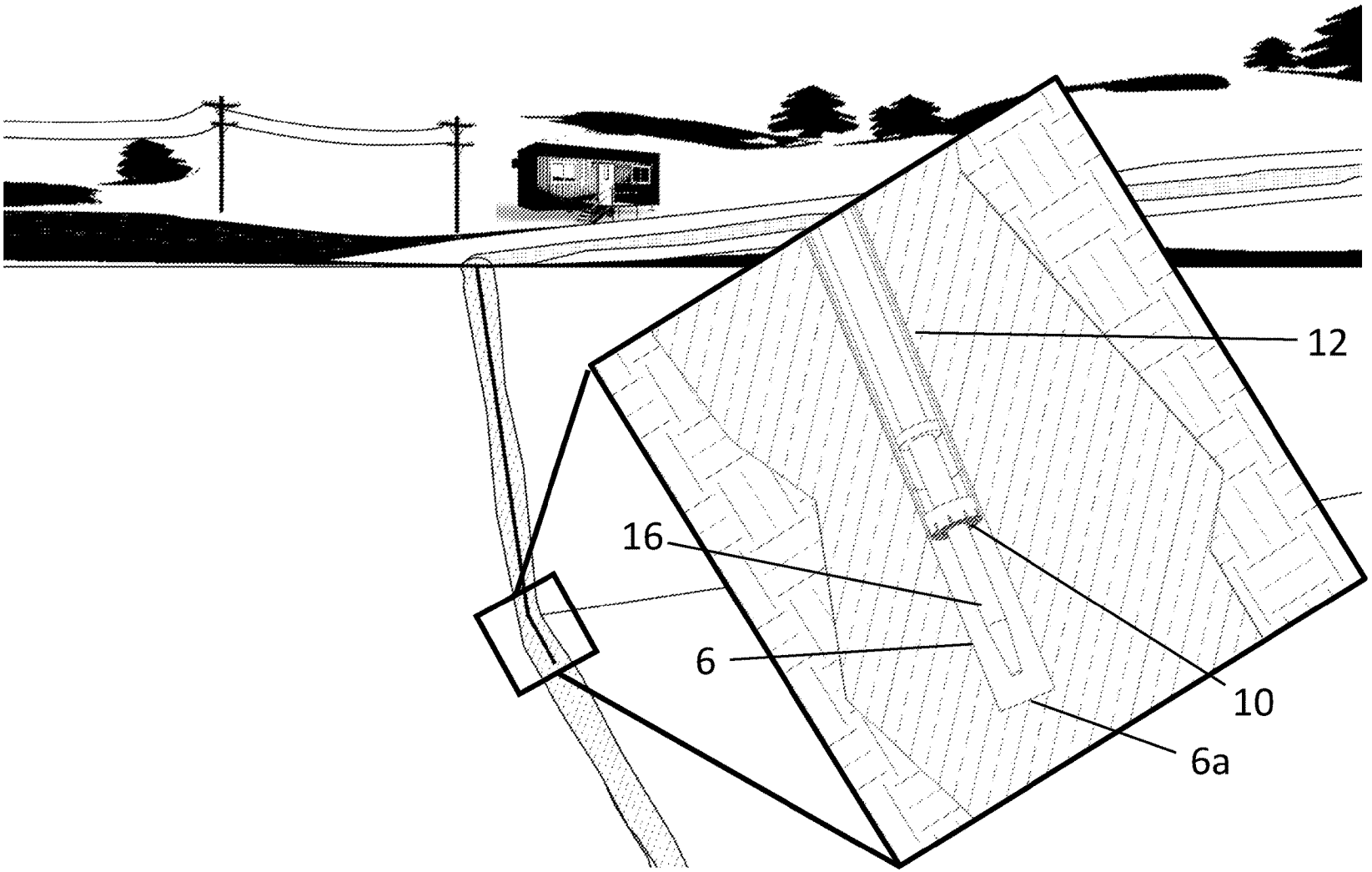

The survey tools may be carried on the drilling assembly or they may be run into the pilot hole from time to time. In one embodiment, drilling is stopped occasionally and the survey tools 16 are run in to assess the vein and position of the pilot hole. This may include pulling string 12 and bit 10 and running in with the survey tool or pulling only a portion of the drilling assembly such as all or a portion of pilot bit 10 such that the survey tool 16 can be run through the string, such as on wireline, and operated in the pilot hole. In one embodiment, when the hole 6 is drilled to survey depth, a portion of the pilot bit, such as wireline core or bit plug 10*a*, is removed to open a passage through string 12 at its distal end, the string is pulled up a short distance from bottom hole 6*a* and at least a portion of survey tool 16 is extended out into the pilot hole to measure well trajectory and distances, including for example, vein imaging (FIG. 1C). Thereafter, the tools 16 can be removed, the pilot bit restored and the course steered, if necessary, to stay along the deposit dip and halfway between the hanging wall and the foot wall. In this way, the pilot hole is drilled within the vein to total depth.

When the pilot hole is drilled to a desired total depth, the pilot hole drilling assembly and string can be pulled out of the hole. The hole can be left open, which is uncased.

Figure 1D:
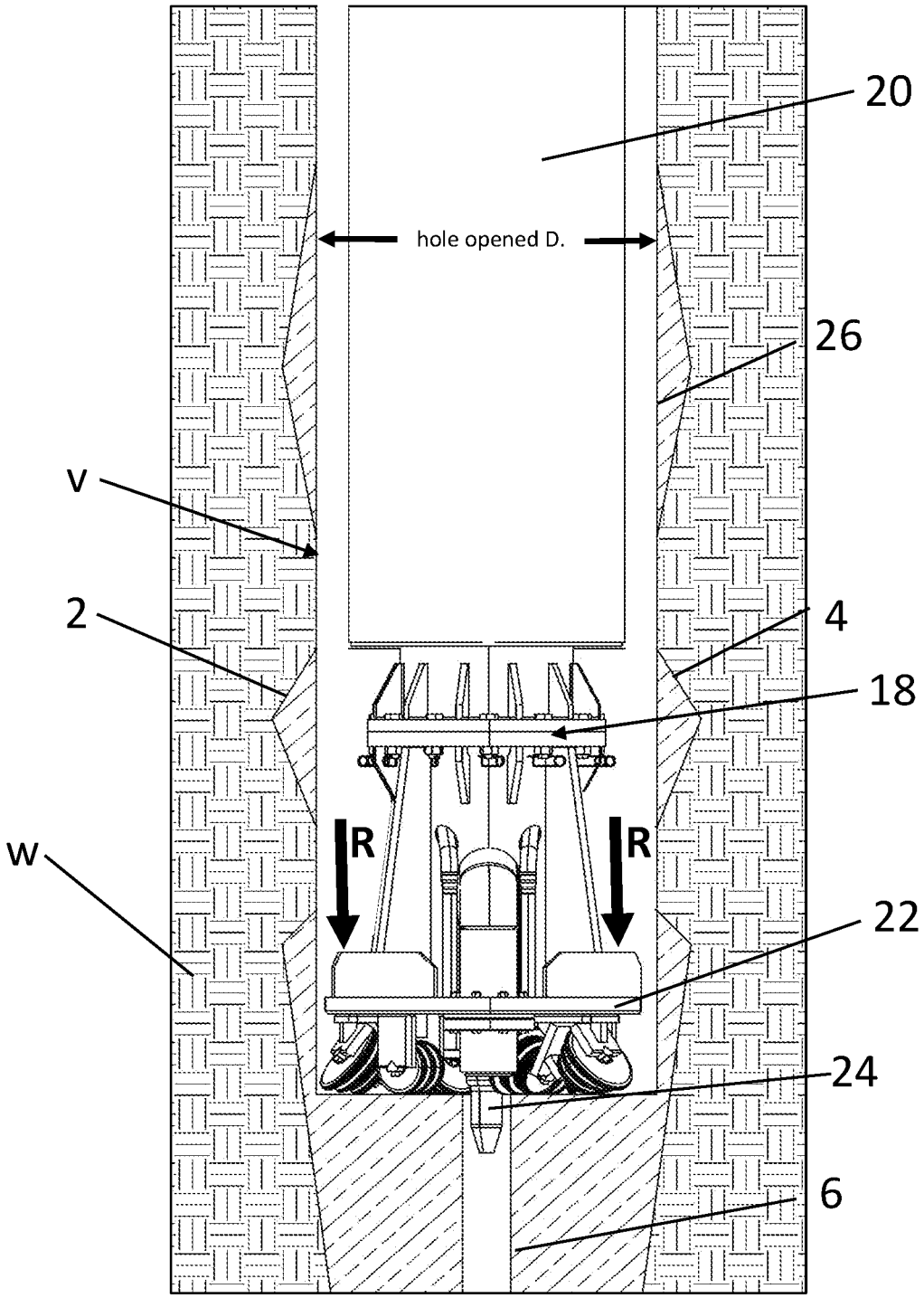
Figure 1E:
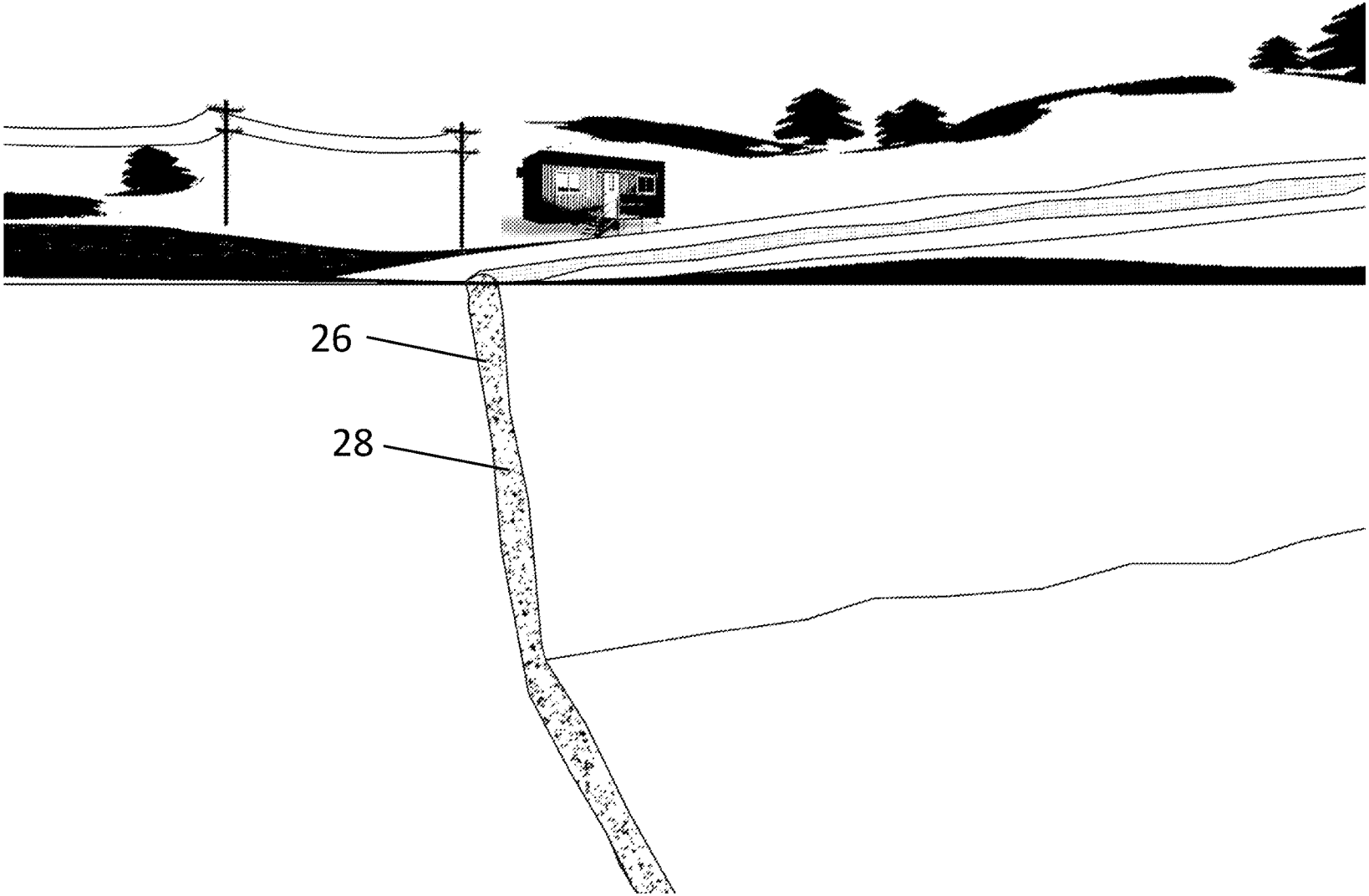
Figure 1F:
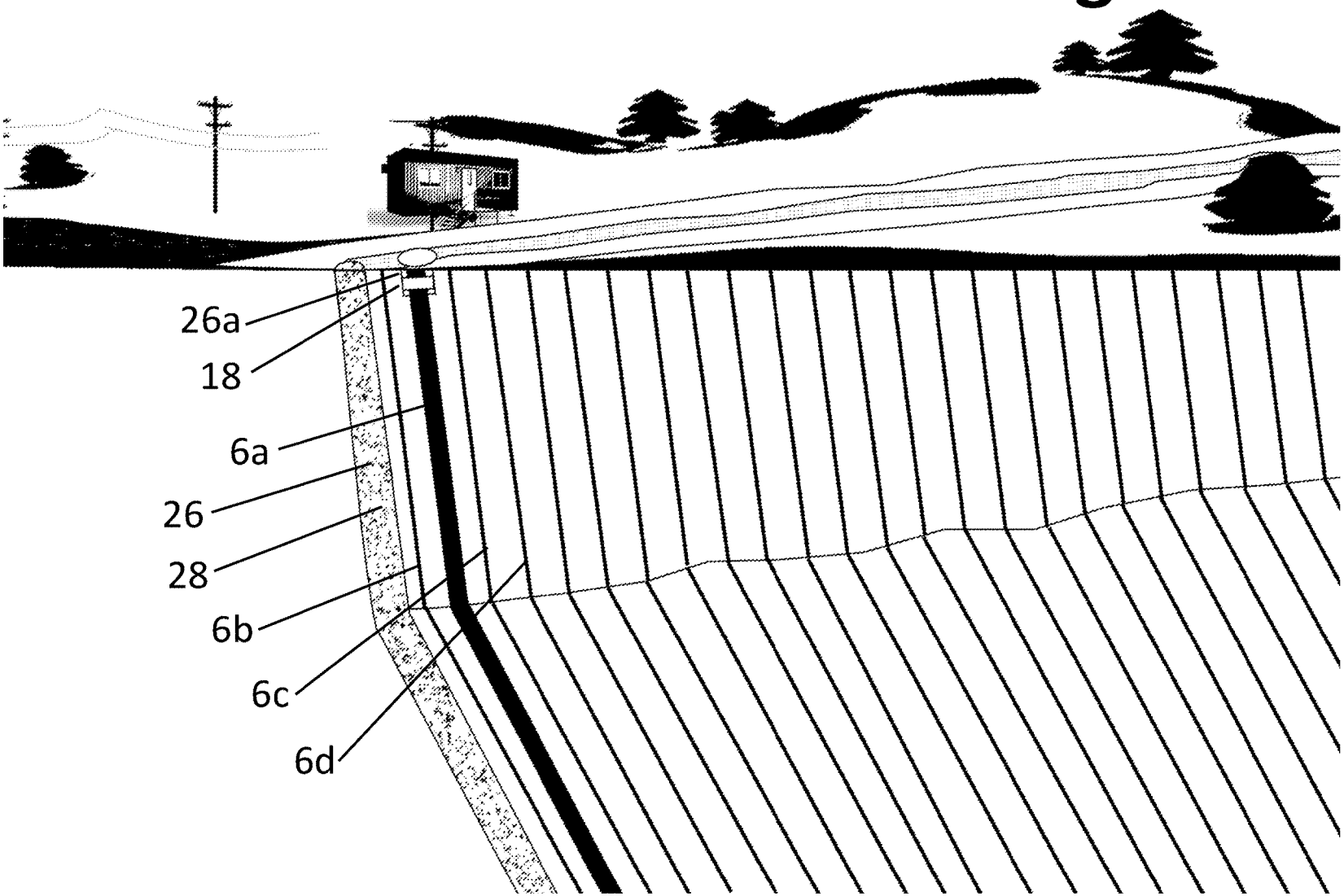

In the second stage, shown in FIG. 1D, hole opening drilling, possibly with underreaming, is used to mine the vein by following the pilot hole. The method includes moving a hole opening assembly 18 along, and centered on, pilot hole 6. The hole opening assembly includes a string 20 carrying a hole opening bit 22 that has a leading end 24 configured to follow the pilot hole. Because the pilot hole 6 has been drilled within the vein v and possibly substantially centered between the hanging wall 2 and foot wall 4, the hole opening bit drills out an enlarged borehole 26 with diameter D centered on the pilot hole. Based on the survey information regarding vein thickness obtained during pilot hole drilling, the hole opening can be extended out to the limits of the vein and the vein is thereby mined out to about its full thickness without drilling up much waste rock w. A hole opening bit drilling diameter can be selected according to the survey/imaging information mapped previously while drilling the pilot hole. The second stage mining proceeds while allowing the hole opener drill string to flex to follow the trajectory of the pilot hole. This second stage can include one or more drilling passes and optionally with underreaming to open the hole to a greater diameter along selected lengths. The diameter of the drilled hole may be 1-3 m and this can be done in a limited number of passes, such as one, by selection of a drilling assembly with a 1-3 m diameter.

The ore is retrieved as drill cuttings that are circulated with circulation fluid flows up to the well head. The drill cuttings can be from the pilot hole, which are circulated up with fluid, arrows F. However, due to the relative sizes of the holes, the ore drill cuttings will be for the most part from hole opening. Circulation may be in the forward or reverse directions. The forward direction being down the string and up the annulus between the string and the borehole wall, while reverse circulation is down the annulus and up the string. In hole opening, circulation, arrows R, may be in the reverse, using reverse circulation drilling methods. The hydraulic pressure of the circulation fluids supports the borehole wall such that no casing or additional hole supports or liners are required. However, if serious instability is found to occur in a vein, the hanging wall can be presupported by installation of cables and bolts before hole opening. The borehole does not require dewatering, as the fluid circulation and lifting of cuttings can occur even in the presence of geological water.

When the drill cuttings arrive at surface, they are then separated from the circulation fluids and ore is recovered from the drill cuttings.

Once the hole 26 is completely mined, the drilling assembly 18 is pulled out of the borehole. Thereafter, the borehole can be filled (FIG. 1E), for example with backfill. The backfill can be include waste mill tailings and optionally a carrier or binder such as cement. Thus, the method may include filling the hole or pumping the tailings and a binder into the hole. This provides an environmental benefit as the tailings need not be stored on surface and the geology is stabilized. In addition, the backfill, when consolidated by a binder, permits a mining-by-drilling operation to be conducted directly alongside the filled borehole.

Figure 1G:
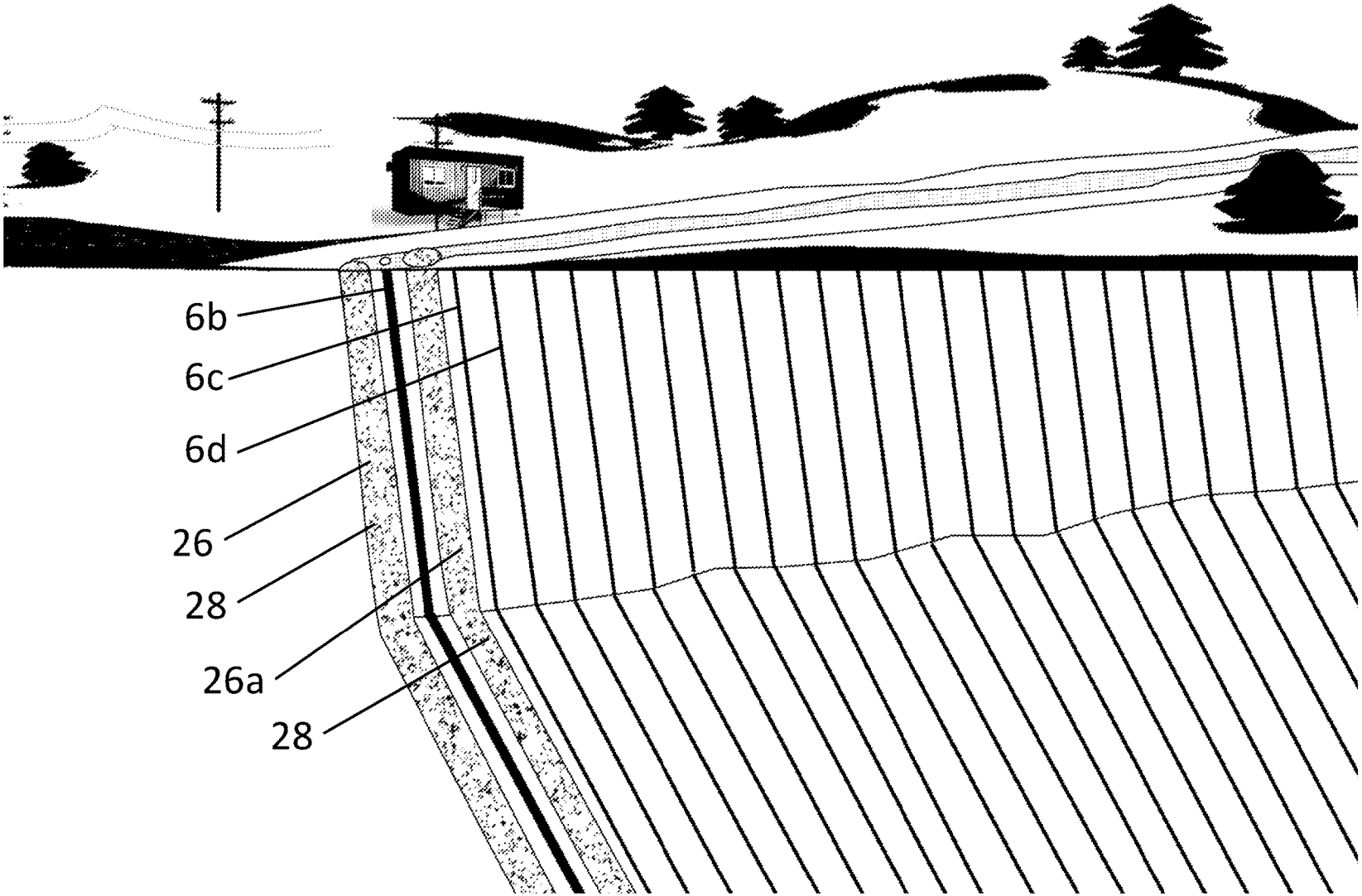

Mining of the vein continues by moving along the strike length of the vein and mining further boreholes including drilling a pilot hole 6*a* followed by hole opening 26*a* at a plurality of locations. In one method, time is permitted to allow the backfill 28 to set before mining an adjacent borehole so that new holes can be mined directly up to, and possibly partially overlapping with, cured backfill in completed holes 26 to ensure maximum ore recovery. One method that permits continued mining while the backfill in the first borehole sets, includes mining and filling a first borehole 26 (termed a primary) and then mining and filling another primary borehole 6*a*, 26*a* spaced apart from the first (FIG. 1F), so that opened borehole 26*a* so that an undrilled portion of the vein remains between the holes 26, 26*a* and borehole 26*a* is out of communication, does not contact or overlap, with the first borehole 26. Further pilot holes 6*b*, 6*c* can be planned to mine a remaining section of the vein. For example, after time is permitted for the backfill in holes 26, 26*a* to set, a secondary borehole 6*b* can be drilled and opened alongside the first primary, to mine the undrilled portion of the vein between the two primary holes 26, 26*a*. FIG. 1G shows the first two primaries 26, 26*a* backfilled and between them, an intervening secondary pilot hole 6*b* drilled and ready to be opened. Further proposed or drilled pilot holes 6*c*, 6*d* will mine a remaining section of the vein. Hole opening can be scheduled for a plurality of primary pilot holes before starting on secondary pilot holes between the oldest primary pilot holes. Alternatively, the mining schedule may alternate primary pilot holes and secondary pilot holes. Pilot hole drilling can be independent of hole opening or the entire pilot hole and hole opening can be completed before moving to a next location along the vein. Because the pilot holes can be precisely placed, the vein can be mined efficiently by hole opening to the vein thickness, controlling any overlap between mined holes or out into the waste rock, and backfilling completed holes.

The method may require site preparation before the first stage. For example, the surface may be cleared to expose the vein or the drilling operation may drill down through surface materials to access the vein.

This method can selectively open the hole substantially only within the vein and minimizes or at least provides control over how much waste rock is drilled up. Thus, the drill cuttings to be processed for ore recovery can have little contamination from waste rock from the hanging and foot walls or backfill from adjacent mined, backfilled holes. This is beneficial for the drill cuttings to be processed for ore recovery.

Each enlarged borehole drilled can span substantially the thickness of the vein, such as 1-3 meters, and can be drilled to a considerable depth, such as 250 m or more along the vein, which in a dipping vein may be about 200 m deep. For a hole drilled into an ore-containing vein of specific gravity 2.8 tonnes/$m^3$, with a 2 meter diameter and a length of 250 m, that hole therefore may produce roughly 2200 tonnes of ore.

A mining system for mining a narrow vein deposit of ore may include: a drilling rig; a pilot hole drilling assembly including a drill head for drilling a pilot hole in the ore, a downhole tool for locating a hanging wall and a foot wall of the narrow vein deposit relative to the drill head and a directional assembly for directing the drill head along a path between the hanging wall and the foot wall; a hole opener assembly including an end configured to follow the pilot hole and a hole opener drill configured to drill a borehole with a larger diameter than the pilot hole to fragment the ore into drill cuttings; and a circulation subsystem to circulate the drill cuttings from the borehole to a wellhead for collection and processing to recover the ore.

The drilling rig, of course, directs drilling fluids, handles the drill pipe and drilling tools, applies weight on bit (WOB) and applies or at least reacts torque in the string. In this system, it is desirable that one rig can handle all of the drilling, both drilling the pilot hole and drilling the enlarged hole. It is desirable that the one rig can handle both the near surface operations and operations through to total depth, all of which are required to mine an entire borehole through the vein. As such, for example, the rig should be capable of handling the drilling equipment for both the pilot hole and for the second stage large diameter, hole. This means, for example, handling drill bits in diameter range of from 10 cm for the pilot hole to 3 meters for the hole opening operation. Considering that a typical gold ore has a host rock strength of about 70-200 MPa and the process includes a large variance in hole diameters, the drilling rig must be capable of applying 10 to 450 kN WOB. The drilling rig may also be configured to drill in slant, in order to drill into dipped ore deposits. The rig may also need to operate with circulation in the forward as well as reverse directions, where cuttings flow up the inside of the drill string to surface.

Considering that the method may require the drilling of a number of spaced apart boreholes into the vein and the remote location of some vein deposits, the drill rig should be relatively mobile. The drilling rig may be movable, for example, by crane, an attached skid or a transport undercarriage such as a trailer or attached tractor conveyance.

In one embodiment, a pile top drill rig may be useful. A pile top drill rig is operated on the top of a casing pipe and is typically used for construction such as placement of piles. A pile top rig includes a floor mounted on top of a casing pipe, table and clamps on the floor and in the casing pipe and a super structure above the floor including an arch-shaped mast with side structures and an upper section, a top drive with power swivel supported in the upper section of the mast and a pull down cylinder in each side structure. A suction pipe is in communication with the top drive. Such a rig is relatively small and capable of being transported to remote locations. While it is normally used for large diameter drilling, the rig in this embodiment is configured for handling equipment to drill holes ranging in size from 15 cm to 3 meters from the same rotary table. Additionally such a rig may be configured for drilling using direct (forward) or reverse circulation. The rig can function with both liquid and gaseous drilling fluids.

The pile top drill rig, however, may require some modifications to most effectively operate for this mining method. For example, since mining sometimes requires drilling early on into bedrock, it may be difficult to place the casing on which the rig is mounted. Thus, the system and method may be configured to carry out additional drilling steps at surface in order to achieve casing placement. In particular, a typical pile top drill rig requires a casing length of about 16 meters to generate enough pressure head to lift cuttings. In this embodiment, the bedrock may be very close to surface and, so, it is difficult or impossible to achieve the 16 meter depth. Thus, the system uses a shorter or variable length casing pipe possibly in combination with pressurized circulation to permit the pile top drive to operate without the 16 meter casing pipe. Modifications may also be necessary to accommodate the hole opening drill string fully below the rig floor before normal drilling operations can be commenced. Also, the rig table and/or top drive may require modification to handle the variously dimensioned pipes such as drill pipe and larger space pipe in one string. Alternatively or in addition, the rig may benefit from a rig to ground surface anchor system to enhance the rotary torque and thrust force capabilities.

Figure 2A:
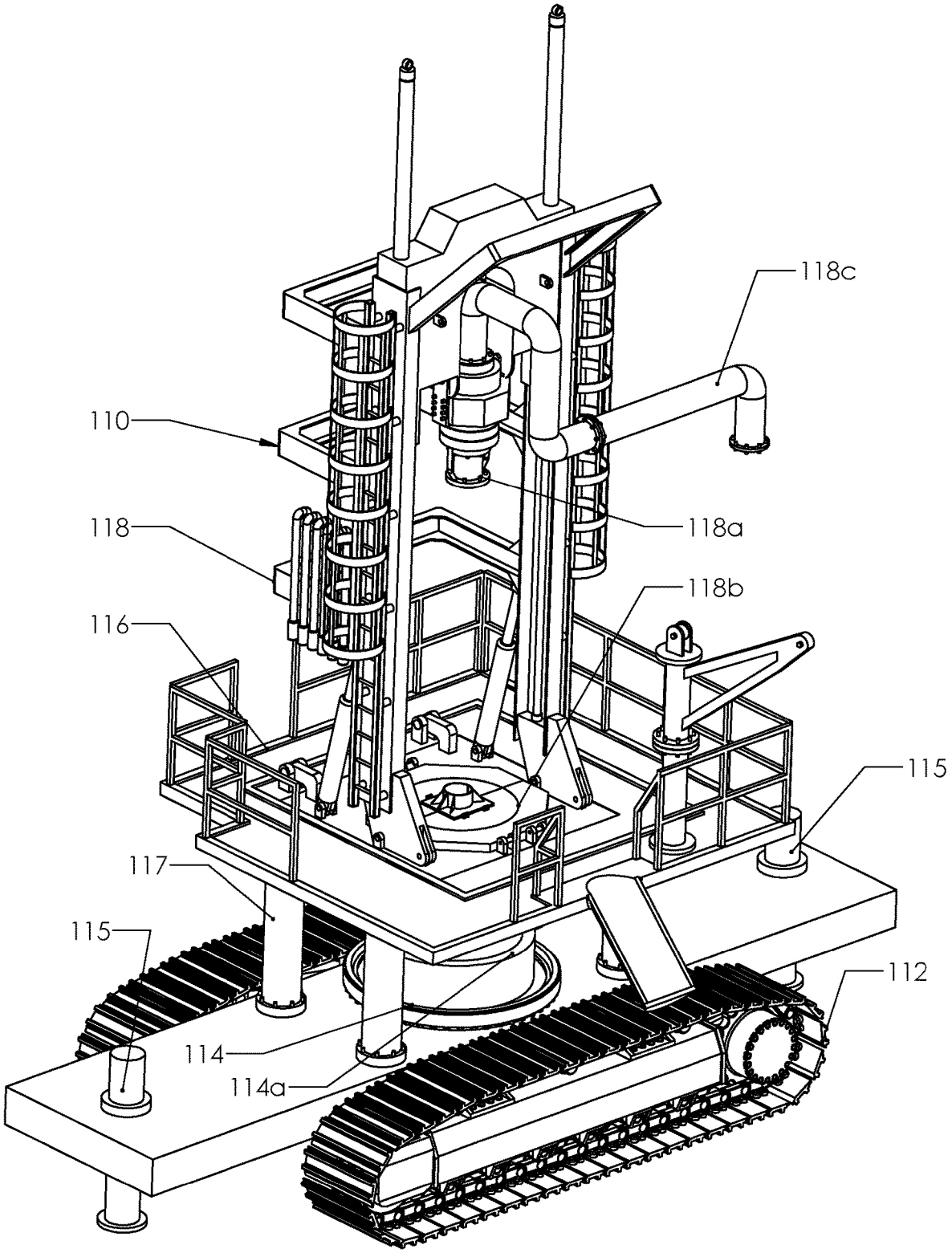
FIGS. 2A and 2B are perspective views of drill rigs useful in the present invention.
Figure 2B:
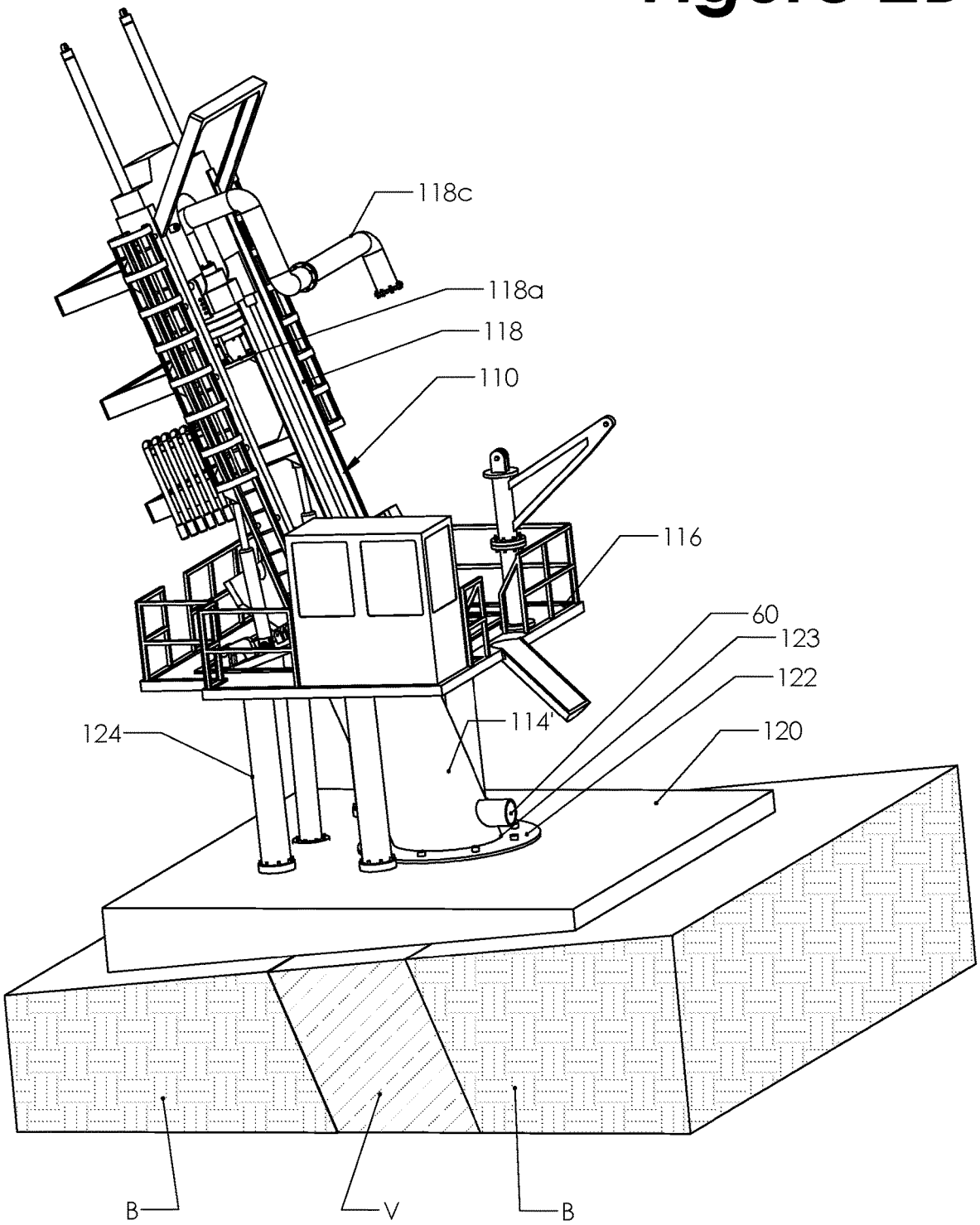

FIGS. 2A and 2B show two pile top drill rigs configured for drilling into a narrow vein. While both rigs are movable due to their compact size, the rig of FIG. 2A is more readily mobile.

The mobile rig of FIG. 2A includes a pile top drill rig structure 110 mounted on a transport undercarriage 112, for example on a track-type, also called a caterpillar-type or crawler, undercarriage. The transport undercarriage allows rig mobility between drilling sites and operational flexibility to drilling operations. The transport undercarriage has the capacity to run on uneven and unconsolidated surfaces. In this embodiment, a casing pipe 114 is supported on the undercarriage. The pile top drill rig is fixed to an upper end of the casing pipe through a casing attachment device. The mobile platform may further include an anchoring system 115 for securing the rig to the ground. The anchoring system may be specifically dimensioned to support the reaction forces during the drilling operation. In one embodiment, the rig is anchored to the ground by grouted rebar anchored firmly into the bedrock. The anchoring system is configured to resist the drilling reaction forces, while avoiding interference with the drilling operations.

The rig may include a base platform for storage of equipment, for example set over the undercarriage.

While not shown, the mobile rig may be configured for operations in slant, where the casing 114 and the rig's superstructure 118, effectively the drilling axis defined between top drive 118*a* and the floor clamps 118*b* is inclined, such as by use of a hydraulic inclination system, for example in the undercarriage. The undercarriage, for example, may include an actuator to tilt the casing 114 and superstructure 118. In one embodiment, there is an undercarriage system, for example based on hydraulic actuation, that drive the casing and superstructure to tilt forwardly or rearwardly relative to the direction of travel, which is parallel to the long axis of the tracks. These functions allow the rig to be inclined to drill a hole that matches the vein inclination angle at surface.

The rig may further be equipped with a floor 116 and a leveling system for the floor, for example also through hydraulic actuators. Thus, permitting the floor to be maintained as level, for example substantially horizontal, even though the undercarriage, superstructure and/or casing are inclined. This facilitates operations for workmen on the floor.

The rig may further be equipped with a height adjustment assembly for the rig deck including height adjustable, such as telescopic, legs 117, a telescoping casing pipe 114 and a system to drive height adjustment movement. This allows for height variation of the rig deck and casing pipe. Drilling operations proceed from the rig deck down through the casing pipe and then into the ground surface, such as the vein, to be mined. Initially casing pipe 114 is set on the ground surface. In particular, similar to the system of FIG. 2B, a lower flange of the casing pipe is installed on the ground surface with an o-ring type seal therebetween to seal the interface and provide fluid containment within the casing pipe. The lower flange may be configured to float on the casing pipe in order to be adjustable for the angle of the casing to be oriented to substantially match the dip angle, while the flange lower face is oriented parallel to the ground surface.

The telescopic configuration 114*a* in the casing pipe, for example, permits the casing length to be longer when the rig deck 116 needs to be higher, for example in the early stages of drilling, and then the casing can be shortened by telescopically collapsing one length of casing axially into a second larger diameter length of the casing. The casing may need to be higher during initial hole opening stages when the hole is more shallow in order to provide the required drilling pressure at bottom hole. As the hole depth increases, the telescopic casing and rig can be lowered to reduce the height of the rig. The telescopic configuration may include a telescoping interface between the two casing lengths and a pressure-holding sliding seal. A casing pipe with the flange may be on the bottom and a vertical displacement assembly, such as a hydraulic system, may be at the telescoping interface to permit adjustment of the casing flange (during installation) and when reducing the height of the casing pipe and rig.

In this mining operation, the casing pipe may be sealed against the surface of, or extend a short distance into, the vein, to permit a fluid seal between the casing and the hole. This permits the hole to be extended with open hole, non-lined, drilling.

FIG. 2B shows a pile top drill rig 110 fixed and installed on a pad 120. While mounted in one position, the costs to dismount, move (as by use of a crane) and remount the rig on a new location along the vein may be an acceptable alternative considering the cost of the movable undercarriage. The pad, made from concrete, may provide a solid, level base onto which the rig's casing pipe 114' can be installed. The pad is poured over an access location for the vein v, for example on a cleared area of rock directly over the exposed vein. If desired, the pad in one operation can extend along a length of the vein greater than the space needed to install the rig so that there is space to move the rig down and drill a next borehole without having to construct another pad. A flange connection 122 may be employed between the casing pipe and the pad. A gasket 123 can be employed between the flange and the pad to improve drilling fluid retention in the above ground casing pipe. The bolts employed to secure the casing flange on the pad should be dimensioned to support the axial and torsional stress during the drilling operation. In one embodiment, the flanged pipe is anchored to the bedrock using grouted bolts/rebar that pass through the flange and penetrate the concrete slab and the underlying bedrock b.

The casing can be installed on a slant that corresponds to the vein's initial angle of inclination such that the drilling axis substantially follows the vein. The casing pipe's flange 122 therefore may be configured as angled, not orthogonal with respect the casing long axis. This flange helps to secure the casing pipe at an inclination, specifically the angle of the flange relative to the long axis of the casing pipe defines the angle at which the casing pipe will extend up from the pad and thereby the drilling axis relative to the vein. The rig floor 116 may be secured in a level, horizontal orientation while rig superstructure 118 above the floor, such as the pipe handling apparatus and top drive, may be on a slant and axially aligned with the long axis of the casing pipe.

The rig may also include support pillars 124 to support the rig floor in addition to the casing pipe. The support pillars are rigidly connected, as by bolting or welding, to the casing 114' and superstructure 118, to thereby act during the drilling operation to accommodate device weight, rotary torque and thrust due to rig pull up force.

The pilot hole drilling assembly acts in the first stage of the method to create a pilot-sized borehole through the vein. The pilot hole follows the dip of the vein and is drilled along a trajectory within the vein, for example, substantially centrally between the hanging wall and the foot wall. The pilot hole drilling assembly includes:

The drill head 10 for drilling a pilot hole in the ore—the drill head may be any drill bit and connections configured for advancing a drilling assembly through ore bodies such as gold deposits. In one embodiment, the drill head may be configured to drill by a combination of rotation and percussion. The drill head is also configured to handle the drilling fluid of interest such as in one example air, mud or combinations. In one embodiment, for example, a hydraulic turbo-type or a pneumatic rotary percussion drill head is employed. The pilot hole drill head may be configured to drill a hole of 10 to 45 cm or more likely 22 to 38 cm. The drill head 10 may be removable up through the string, while the string remains down hole, or it may include a removable core barrel or bit plug 10*a*, to permit access to be opened from the string's distal end out into the borehole.

The downhole survey tool 16 for locating the hanging wall and the foot wall of the narrow vein deposit relative to the drill head is a non-destructive survey tool such as a downhole imaging tool. The survey tool is configured for near borehole imaging and may include, for example, a geophysical tool incorporated on the drill head or conveyed by string or on wireline and employing technologies such as one or more of ground penetrating radar, high frequency acoustic, ultrasonics, x-ray, magnetic resonance imaging (MRI), etc.

In one embodiment, a near borehole imaging tool is used during the pilot hole drilling stage. At various depth intervals while drilling the pilot hole, a survey is taken with the imaging tool. If the imaging tool is not incorporated into the pilot hole drilling assembly, surveying may include running into the hole with the downhole imaging and survey tool either by wireline and/or by attachment at the end of the drill string.

One possible downhole imaging and survey tool has two major components: i) The first component is a geophysical imaging system that provides a high resolution image of the near well bore region to identify the distance of the borehole from the hanging wall and foot wall vein contacts, information about the continuity of the vein in the lateral direction along the strike of the vein, and information about the continuity of the vein ahead of the bit; and ii) The second component is a directional information system including a combination of accelerometers, magnetometers and north-seeking gyros that provide the information about the inclination and azimuth of the borehole trajectory, and the tool face angle of the imaging tool.

The downhole imaging and survey tool information is used to determine if the bore hole trajectory is deviating from a path within the vein, for example a position about halfway between the hanging wall and foot wall vein contacts, if the trajectory is deviating from the dip of the vein, if the vein is changing thickness or direction, or some combination of these. If the bore hole is deviating from the required trajectory, then the near well bore information is used to plan a trajectory adjustment using downhole steering tools.

The geophysical imaging system for the survey tool may be ground penetrating radar. However, other embodiments using high resolution acoustics, ultrasonics, XRF, or magnetic resonance imaging (MRI) are also possible.

The pilot hole drilling assembly also includes the directional assembly 14 for directing the drill head along a path between the hanging wall and the foot wall. The directional assembly is configured to steer the drill string such that it can drill the pilot hole path within the vein, for example substantially centrally between the hanging wall and foot wall. The directional assembly may include wedges, whipstocks, bent subs, automated kickers or other directional tools. Care may be taken to ensure that the directional assembly works with the drill string, drill head and fluids being employed.

The pilot hole drilling assembly drill string may further include drill collars, stabilizers, centralizers, logging tools, etc.

While the rig can be operated both for the first and the second stage drilling, during the first stage, pilot hole drilling, the system may require a crossover 112*a* to connect American Petroleum Institute (API) drill pipe in the pile top drill rig. The crossover is an interface between the top drive of the pile top drill rig and API standard drill string. It allows direct circulation of the drilling fluid. The lower end of the crossover is an API pin connection. The crossover may include a connection between the fluid injection points of the top drive. In particular, if rotary percussion drilling tools are used to drill the pilot hole, compressed air, with or without foam, is used and is direct circulated down the string and up the annulus. The proposed crossover allows switching over from the direct compressed air circulation of pilot hole drilling to the air lift assisted reverse circulation of the hole opening drilling.

Figure 5:
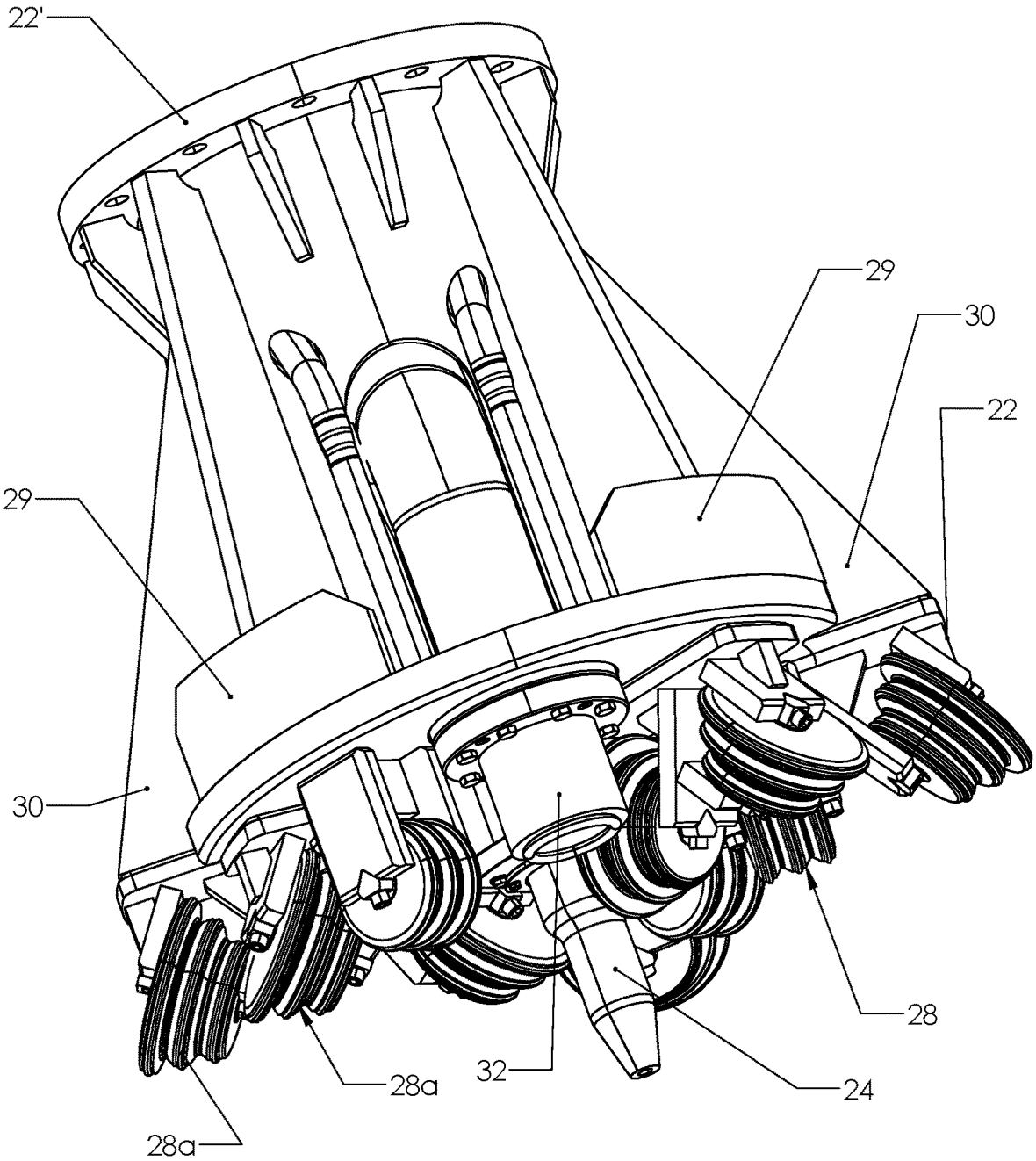
FIG. 5 is a perspective view of a hole opening bit useful in the present invention.

The hole opener assembly acts in the second stage of the method after a length of the pilot hole has been drilled to enlarge the hole diameter along the pilot hole. This, thereby, recovers more of the ore within the vein. There may be one or more passes of the hole opener to enlarge the hole to substantially the thickness of the vein. The process may include underreaming so that thicker regions the vein can be mined with the hole opener. With reference to FIGS. 1D and 5A and 5B, one useful hole opener assembly includes:

A. The lower, guide end 24 configured to follow the pilot hole—The hole opener assembly is intended to follow the pilot hole. Thereby, the hole opening mines an enlarged radius around and beyond the pilot hole radius within the vein. The guide end is configured to find and keep the hole opener centered on and following the pilot hole. Guide end 24 may be, for example, a stinger, alternately called a bullnose, which is an elongate extension sized to fit into and be pushed along the pilot hole. The guide end 24 may have an outer diameter just less than the pilot hole and may include a bearing surface to increase its resistance to wear as it moves along the pilot hole. Guide end 24 may be configured to rotate, as this may assist with penetration. While it may not be generally necessary, if the guide end rotates, it may have a drill bit on its lower end.

B. The hole opener drill 22 is coupled directly or indirectly to an upper end of the guide end 24. The hole opener drill is configured to drill a borehole within and along the deposit. The hole opener drill includes a cutting face 28 including cutters 28*a* and a stabilizer surface 29. The borehole has a larger diameter than the pilot hole and the drill acts to fragment the ore around the pilot hole into drill cuttings. While the guide end 24 is urged along the pilot hole, the cutting face 28 engages and cuts into the rock around the pilot hole. Each hole opener drill 22 is at least sized with a diameter larger than the pilot hole. At least one hole opener drill, the final one if there is more than one, has a diameter selected to mine a final diameter within the vein. The intention of the hole opening process is to drill up substantially all of the ore across the thickness of the vein without significantly drilling into the waste rock on either side of the vein. Thus, the final hole opener drill may for example have a maximum diameter about the same as, for example +/−10%, as the thickness of the vein from hanging wall to foot wall, which is up to 3 meters and generally is about 1-2 m. If the diameter of the hole is to be enlarged in a number of runs, there may be a number of hole opener drills that are used one after another. However, in one embodiment the hole is opened to the selected full diameter by a single hole opener drill.

In order to ensure that as much of the vein as possible is mined, the hole opener drill may include an underreamer mechanism 30 that permits at least some of the cutters 28*a* to be expanded out to a larger diameter while the drill bit remains downhole. Thus, if the thickness of the vein is greater along a depth, for example, as determined by surveying and imaging during the pilot hole drilling process, the hole opener drill can be expanded to a larger diameter along that particular length. This permits the hole to be underreamed and a larger diameter to be mined along certain lengths of the hole. For example, underreaming can increase the hole diameter by up to 30% over the hole opener drill's normal diameter. Thus, while it is preferred to drill the smallest diameter hole for rate of penetration and to avoid drilling up waste rock, where the vein has a greater thickness along a particular length, the hole can be mined out closer to the contacts of the hanging wall and the foot wall along that particular length. If desired, the hole opener drill can then be retracted to the original hole opening diameter after the underreaming process. This allows as much ore as possible to be recovered from the vein in a single hole opening operation.

The drilling parameters influence the drill cuttings size distribution and this influences the ore grinding and comminution requirements in the ore processing and separation processes and equipment. For example, in traditional ore processing, a significant amount of energy is expended in crushing ore to a fragment size suitable for ore extraction. Herein, drilling parameters such as bit size may be selected to fragment the ore as it is mined, for example as the pilot and larger diameter holes are drilled, to break down the ore into a more suitable size for ore extraction. Thus, a bit size may be selected that fragments the vein into an average cutting size of less than 5 cm diameter, or possible less than 1 cm or less than 5 mm. Cuttings of that size can be readily removed by fluid circulation and are readily processed at surface.

In one embodiment, the hole opener drill may be a reverse circulation type drill bit including fluid inlet ports 32 adjacent cutters 28*a* such as on the cutting face.

C. The hole opener assembly also includes a drill string 33. The drill string is connected to the hole opener drill 22 at its upper end 22' and movement of the drill string axially, towards and away from surface, also moves the hole opener bit and guide end 24. As well, rotational movement of drill string also rotates the hole opener assembly including hole opener bit 22 and guide end 24, to thereby drill up the ore in contact with the bit cutters 28*a*.

The drill string employs joints of pipe 34 capable of conveying torque to the hole opener bit and conveying drilling fluids and/or returning drill cuttings. In one embodiment, the drill string includes large diameter drill pipe (for example 15 to 45 cm or more likely 22 to 38 cm) connected by bolting together the flanged ends of the drill pipe. The bolted flanged connections enable the drilling string and bit to be rotated in both directions as required to prevent stuck drill strings, to clear accumulated cuttings, etc. The bolted flanged connections, possibly with an O-ring at the interface, also provide a good seal against leakage of the drilling fluid and cuttings during recovery circulation.

The above-noted drill string has been found to operate well in the system. However, if the use of these large diameter, flange-to-flange connected pipes make the drill string too rigid and unable to adequately bend to follow the varying directions of the pilot hole as it follows the vein, the drill string may be modified to increase its flexibility. For example, it can be reconfigured with a degree of flexibility such as up to 5 degrees of flexure. In one embodiment, shown in FIGS. 3A and 3B, flexible drill string joints are employed that include an elastomer ring 40 with a steel lining 42 that is sandwiched between the flanged ends 44*a*, 44*b* of at least some, for example every second or third, drill string joints 34. The elastomer ring 40 is positioned between the flange 44*a* of the first pipe and the flange 44*b* of the second pipe, such that the two flanges are spaced apart and out of contact. The steel liner is a cylinder with an inner diameter approximately the same as the inner diameter ID of the pipes being connected. The steel liner is positioned butting between the pipe ends to transmit compressive forces through the string and limit axial loading to maintain the elastomer ring from extruding into the inner diameter.

The flanges are then bolted together using stiff resilient washers 46, such as Belleville washers, about the bolts 48. Such a flexible connection enables the joint to flex without breaking the bolts or compromising the seals between the flanges. With such a flexible connection, the drill can still transfer the high rotary torque between the drill string components, but the drill string can flex so the large diameter hole opener can readily follow the directional pilot hole and the drill string can flex along the varying trajectory.

Figure 3A:
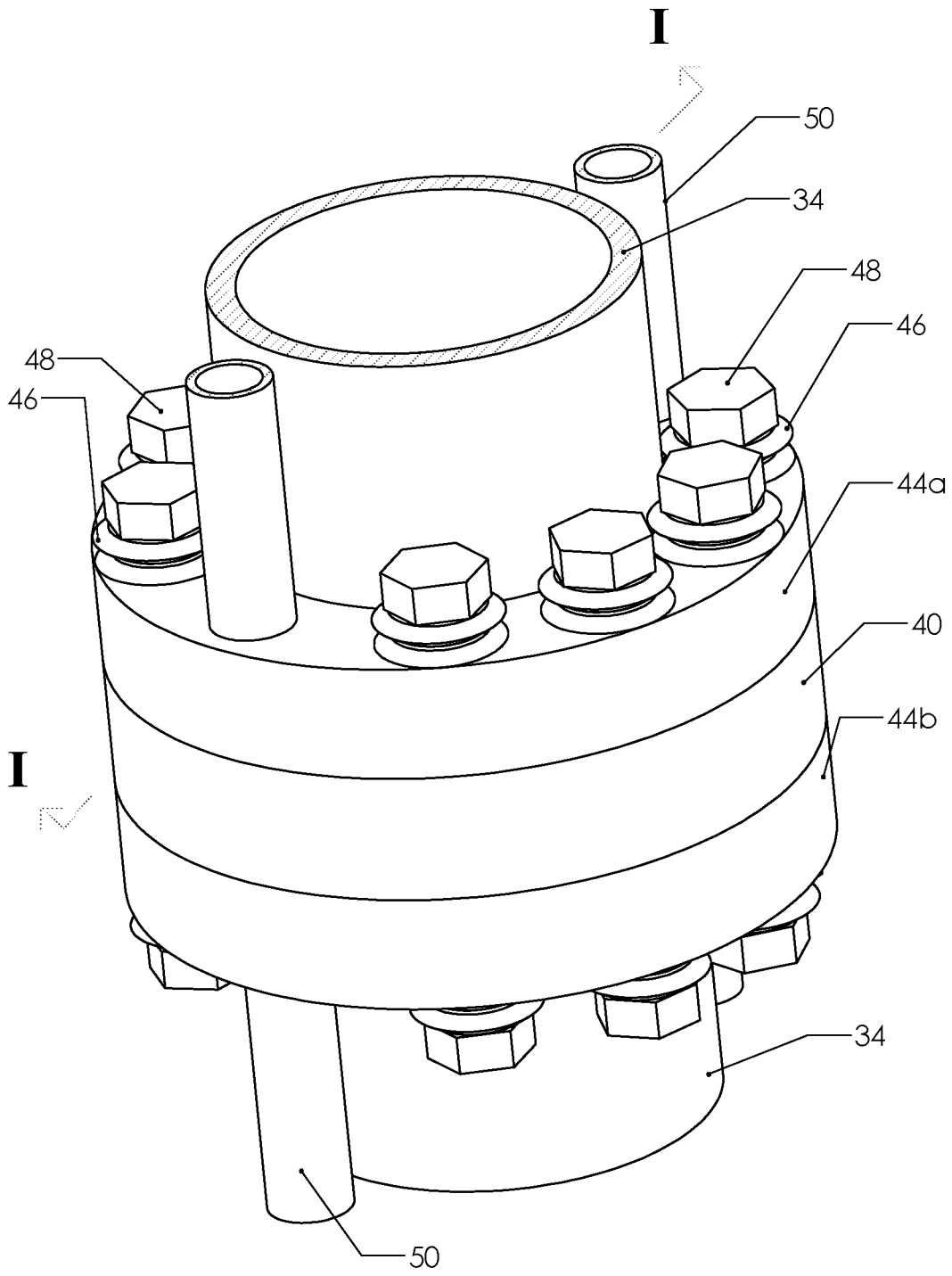
FIGS. 3A and 3B are a cutaway, perspective view and a section along line I-I, respectively, through a flexible drill string joint useful in the present invention.
Figure 3B:
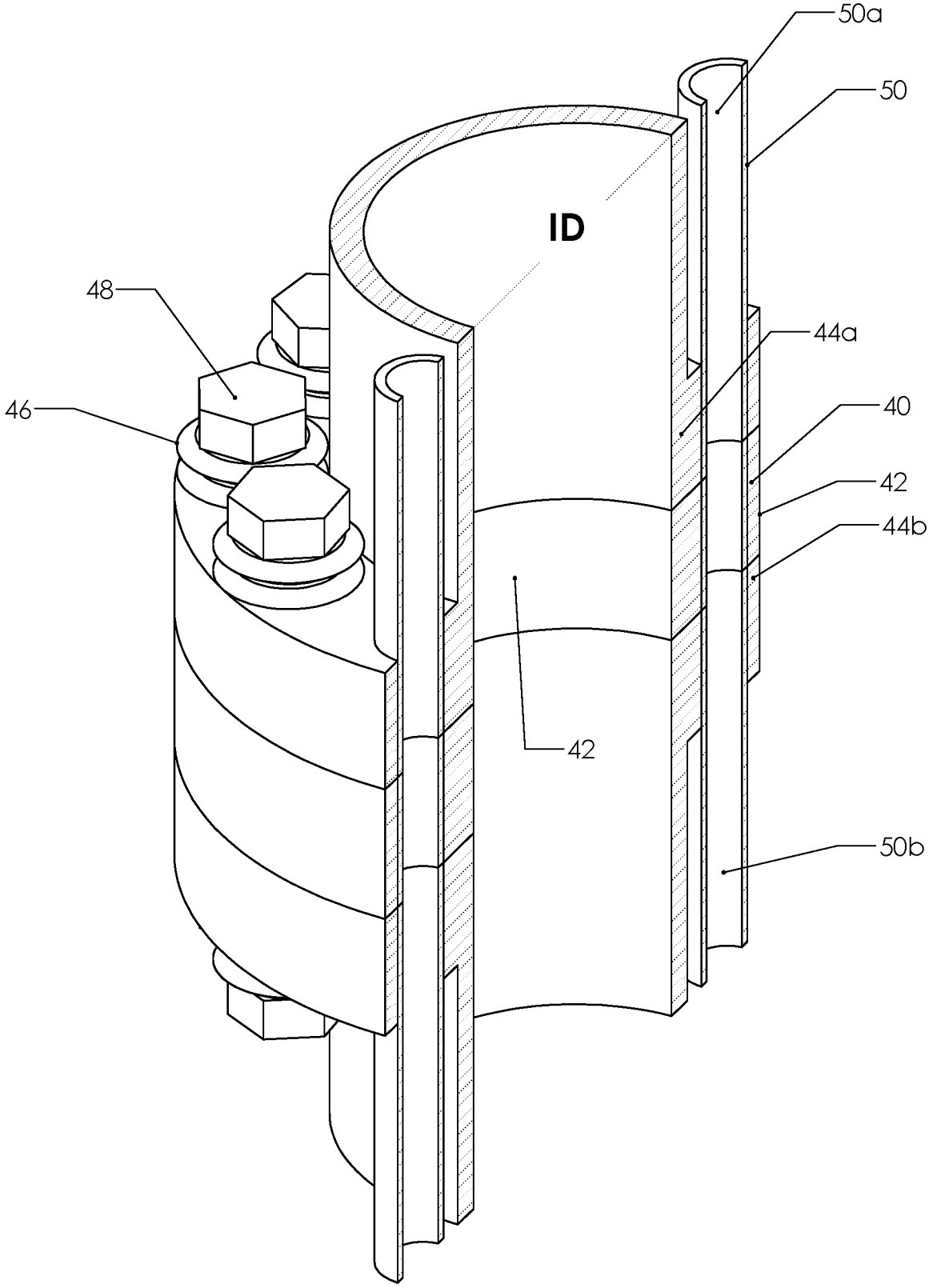

In one embodiment, the drill string is configured for operations employing reverse circulation of fluids and for example, may have a plurality of conduits for circulation down of air to improve circulation up of conveyed drill cuttings. The drill pipe may have a plurality of walls such as being configured as double walled or have external conduits for such air injection. With reference also to FIGS. 3A and 3B, the drill sting may include one or more external conduits 50 that run alongside the main drill pipe to convey compressed air down the string. Each conduit extends down to a port through the drill bit. The port discharges at an injection point localized on the hole opener drill bit. The discharge is on the face of the bit close to the bit circulation inlet for cuttings to be conveyed though inlet ports 32 to the string inner diameter ID. Each conduit 50 may be secured at the flanges 44*a*, 44*b*. In one embodiment, each conduit is formed of a plurality of tube segments 50*a*, 50*b*, with each segment installed between the upper and lower flanges of a drill pipe, the upper end of the segment terminating and sealed in the upper flange and the lower end of the segment terminating and sealed into the lower flange. Communication between aligned pipe segments at the joint is through the flanges and a hole through the annular ring 40. Thus, while the segments form a continuous conduit along a plurality of pipes, flexibility is retained along the conduits in the same way it is provided at the drill pipe connections.

The conduits convey compressed air down to allow an increase in the bottom hole pressure during the hole opener drilling operation. This type of drill pipe, with conduits for injection of compressed air, may be used during the hole opener drilling operation with reverse circulation when there is not sufficient bottom hole pressure to support cuttings transportation, for example when hole opening bit is close to the surface. The compressed air mixes at the bit with the water in the hole and facilitates lift. The hole can be filled and refilled with water to replace that lifted out with the cuttings.

The drill string may also include stabilizers, and other drilling tools. The stabilizers may be employed every 2 to 4 pipe joints. The stabilizers may be the same diameter as the hole opener drill bit.

The circulation subsystem circulates drilling fluid through the well, for example, to lift the drill cuttings from the borehole to a wellhead for collection and processing for ore recovery.

The type of drilling fluid selected may depend on the type of drilling. For example, drilling fluids may be water-based, foamed or gaseous. It is possible that one type of fluid will be used for pilot hole drilling while another type of fluid is used for hole opening. In one embodiment, compressed air is employed for pilot hole drilling, possibly with foamed compressed air at greater depths. For hole opening, water may be used optionally with air lift assistance, as described above with respect to conduits 50.

The circulation system may include pumps, conduits, valves and a device to change the drilling fluid circulation direction (reverse vs direct) at the drill rig. This device allows drilling fluid circulation direction to be changed and can work with various fluid types such as water, compressed air, and foam. The device may include a valve set and a mixer that can produce foam with selected characteristics. In one embodiment, the circulation direction is switched when reconfiguring from pilot hole drilling to hole opening drilling.

The drill cuttings both from pilot hole drilling and hole opening are valuable, as they contain ore. Thus, there are cutting collection systems that collect the cuttings in both stages. Thus, the system includes collection pathways operable both for direct and reverse circulation. There may be returns from the drill string or from the annulus depending on the direction of circulation. Thus, cuttings-containing returns may be conveyed through the top drive 118*a* and out through a discharge line 118*c* or out through ports 60 in the casing for annular communication.

As noted above, casing pipe 114, which spans the distance between the rig deck 116 and the ground surface, accommodates therein drilling operations and equipment both for pilot hole and enlarged hole drilling. The casing pipe 114 therefore has an inner diameter large enough to permit passage therethrough of the hole opening assembly and therefore may be at least one meter and may be about 3 m in diameter. There are a few considerations with operations through the casing pipe.

As noted above, in some situations, such as when drilling close to surface (i.e. when the bottom hole assembly is just starting to drill or is close to surface), there may be insufficient casing height and head volume to provide adequate drilling pressures. In such an embodiment, the hole pressure above the bit may be increased to provide a more suitable hydrostatic pressure.

Figure 6A:
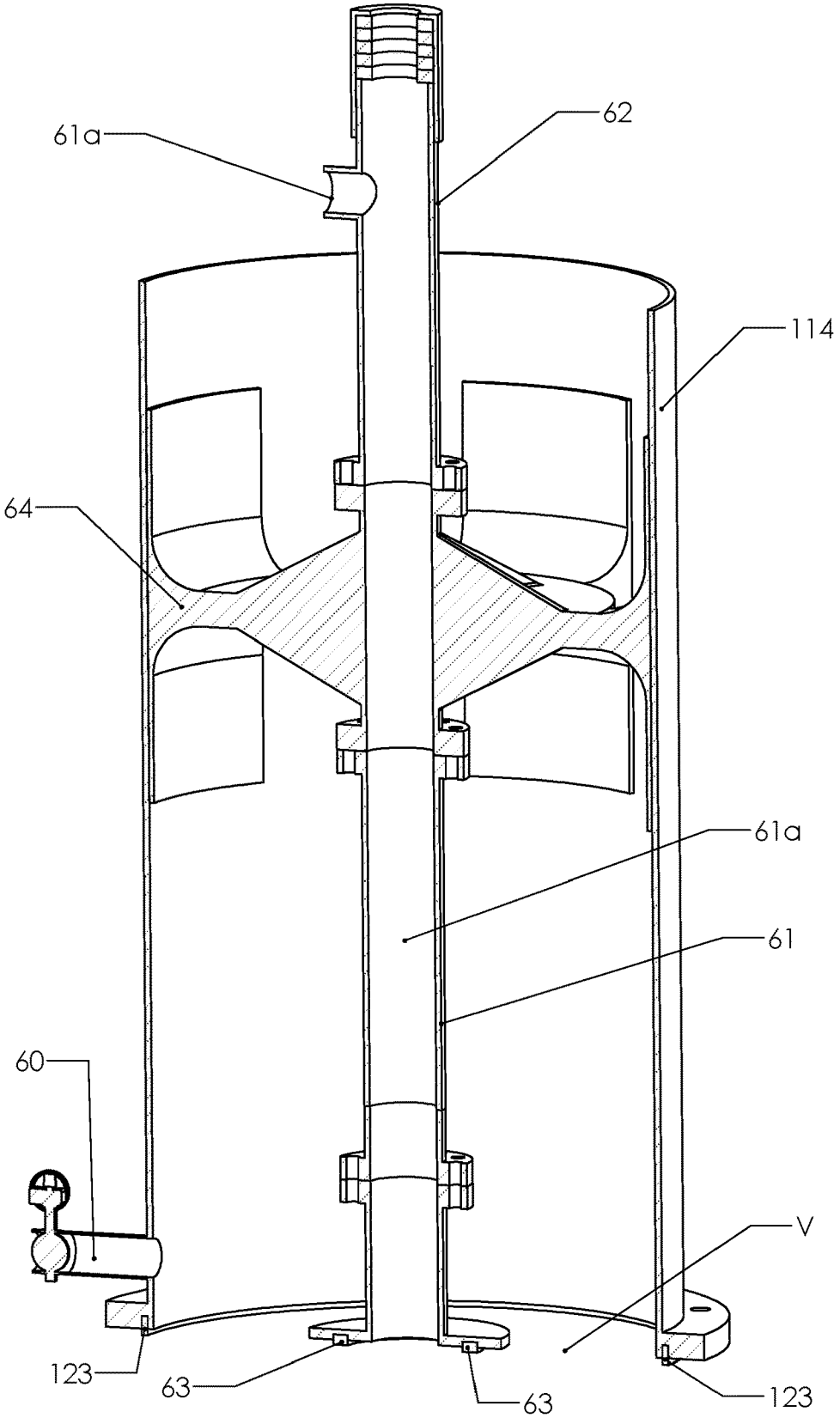
FIGS. 6A and 6B are enlarged views of a pipe housing for near surface fluid handing in a pilot hole drilling operation.
Figure 6B:
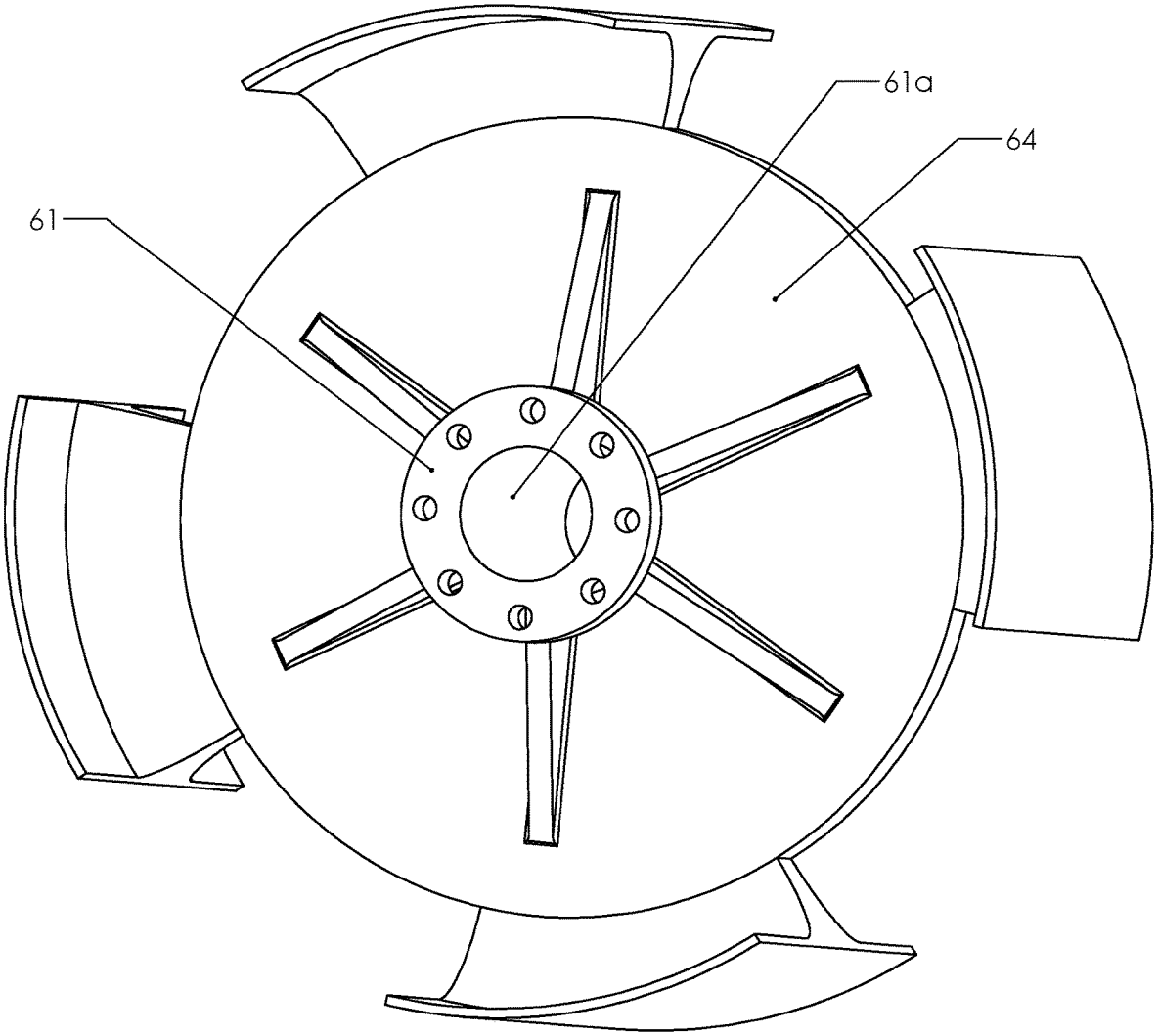

For example, when drilling the pilot hole, the drill string is many times smaller diameter than the casing pipe 114. As such, when drilling the pilot hole, a cutting collection device and adaptor for the smaller diameter drilling pipe 12 may be employed, which is configured to stabilize the smaller diameter string inside the larger diameter casing and to allow the drilling fluid and cuttings to flow out during the pilot hole drilling operation. As shown in FIGS. 6A and 6B, that device includes a pipe housing 61 with a diameter larger than the outer diameter of drill string 12, but much smaller than casing 114. The pipe housing provides a fluid tight conduit through which string 12 can be run and operated. The pipe housing extends along the length of the casing 114 to span between the rig deck and clamps 118*b* and the ground surface, such as exposed vein v, into which the pilot hole is to be drilled. The pipe housing 61 creates an annular space between its inner wall 61' and the drill string, to accommodate fluid circulation. Thus, during direct circulation, which is normally used with the pilot hole drilling assembly, the drilling fluid and cuttings can to flow out of the annulus and prevent cuttings from going down the pilot hole. In addition, the device includes i) a stuffing box 62 that isolates the hole from atmospheric pressure; ii) a centralizer 64 on the pipe housing that stabilizes and fixes the device inside the casing pipe 114; iii) a port 61*a* through which the drilling fluid and the cuttings can exit the pipe housing; and iv) an elastomeric seal 63 installed between a bottom end of the pipe housing 61 and the ground surface. Elastomeric seal 63 avoids leakage of drilling fluid between the housing pipe 61 and the ground surface. In the pilot hole drilling operation, the device including pipe housing 61 is fixed substantially co-axially inside the casing pipe 114 through centralizer 64 and a return line is connected at port 61*a*. A drilling pipe string 12 can be run in through stuffing box 62 and worked inside housing 61. A normal pilot hole drilling operation can be commenced from housing 61 into vein v. Below seal 63, the pilot hole is drilled open hole. Direct fluid circulation can exit the hole through pipe housing 61 and be discharged through port 61*a*. The space between housing 61 and casing 114 remains open but is not in fluid communication with the inside of pipe housing 61. When the pilot hole is complete, the device including pipe housing 61 and centralizer 64 is removed from the casing pipe 114. This leaves the casing pipe open for drilling activities with the hole opener assembly 18.

Figure 4A:
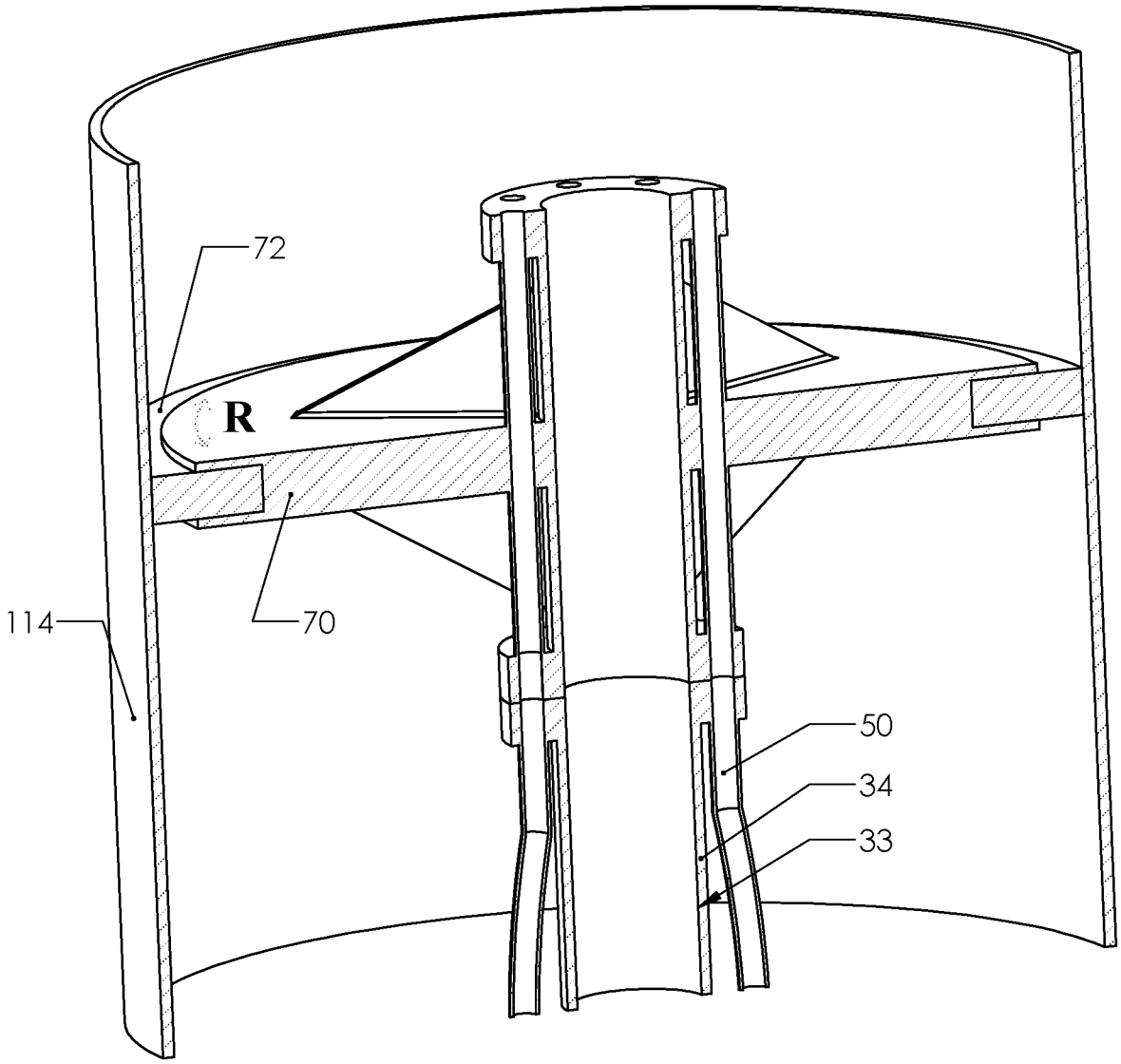
FIGS. 4A, 4B and 4C are, respectively, an enlarged installed view, perspective parts view of one casing embodiment and an overall installed rig view with another casing embodiment, respectively, of upper pressuring systems and hole enlarging assemblies useful in the invention.
Figure 4B:
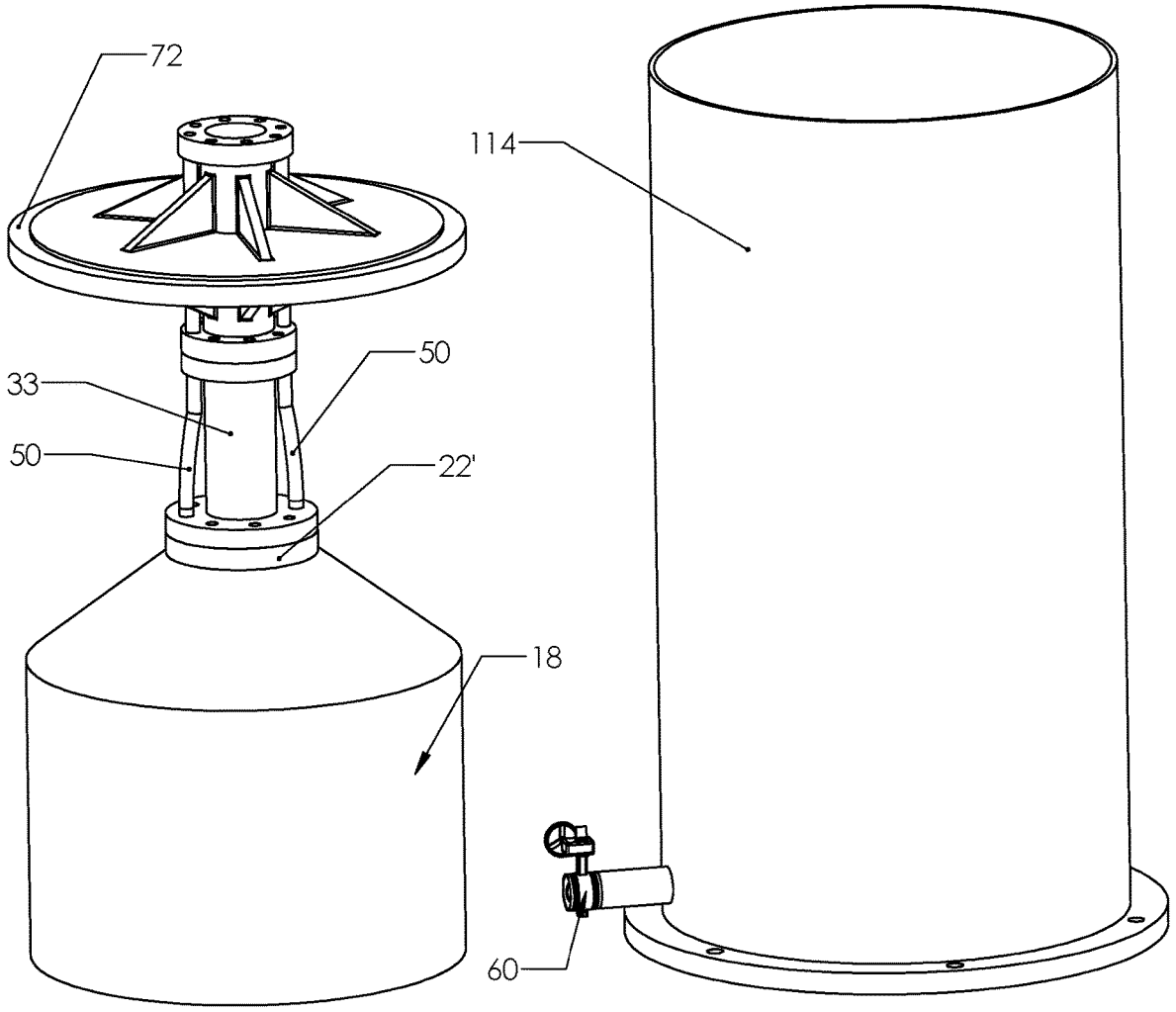
Figure 4C:
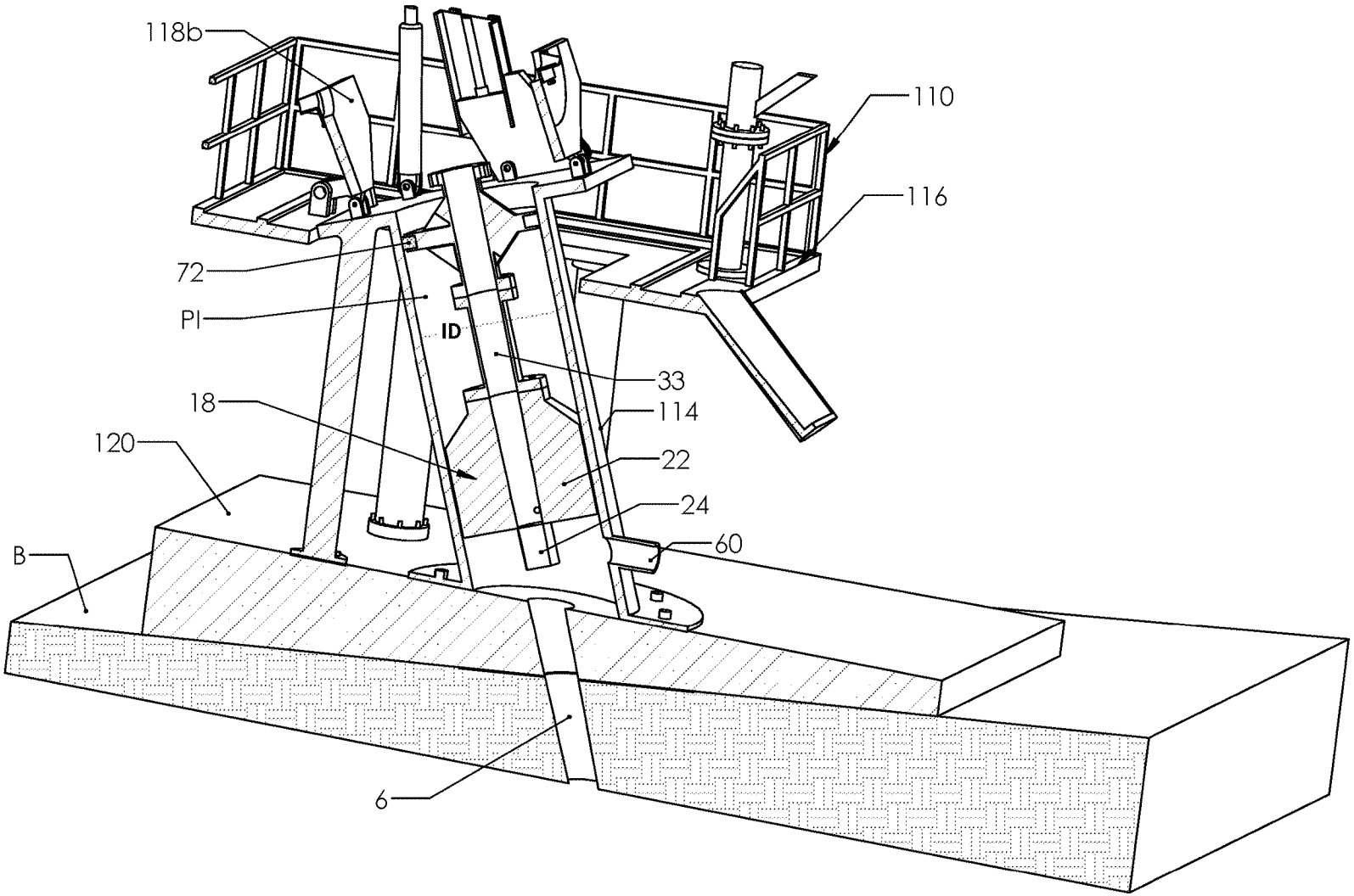

It was noted above that steps may be taken to ensure adequate hydrostatic head when drilling near surface. This is particularly, noted during hole opening. As noted above, in some embodiments, the casing pipe 114 and rig can be elevated to achieve about a 16 m casing column height above the bit face. With reference to FIGS. 4A-4C, sufficient drilling fluid pressure $P^I$ in the upper annulus can be achieved by pressuring up the annulus above the hole opener bit 18, possibly with forward circulation. For pressuring up the annulus, an apparatus can be employed that creates an annular seal between the hole opening drill string 33 and the inner surface of casing pipe 114, so that the pressure can be increased therebelow. The upper pressuring apparatus is installed on string 33 and positioned in the casing 114. The apparatus includes a flange 70 with an annular seal 72, together forming a rotating seal assembly, which spans the annular area between the casing and the drill pipe. The flange can rotate with the drill string while the pressure seal is maintained through seal 72 being urged against the casing pipe wall. FIG. 4C, for example, shows bit 22 ready to spud an enlarged borehole through pad 120 and into the bedrock or vein as guide end 24 rides in pilot hole 6. While the casing length as illustrated is not high enough to provide sufficient hydrostatic head for drilling operations, the pressure below flange 70 and seal 72 can be increased to that pressure $P^I$. The casing above flange 70 is open to atmosphere.

As drilling progresses, flange 70 moves down in casing pipe 114. A port such as port 60 maintains fluid communication between the casing pipe and the annular area between string 33 and casing pipe 114 and is the port through which the annular pressure is maintained. The rotating seal assembly, therefore, must remain above that port. Thus, eventually the string 33 and flange are pulled out of the hole and further pipe joints are added to the string between flange 70 and bit 22. When the hole opener reaches a depth where the fluid column is sufficient to support drilling operations, the rotating flange assembly may be pulled out of the hole and hole opening can proceed without pressuring up the upper annulus. The opened hole is mined without a casing liner and the seal 123 prevents leakage. At that point, if circulation was in the forward direction, circulation may be reversed to bring returns up through the string 33 inner diameter.

During hole opening, the drill cuttings are collected at the well head and processed for ore recovery. Regardless of whether they arise from pilot hole drilling or hole opening, return flows are a mixture of cuttings and the fluid used. The cuttings can be separated from the fluid by passive settling or active phase separation. Settling can be in a settling chamber or tank or in a pond. Active processing may be by cyclones or screens such as shale shakers. The rate of separation or the fragment size may guide choices.

The cuttings, once separated, are processed for ore recovery. Because the vein is fragmented through the mining by drilling process, the crushing and grinding requirements may be minimized and possibly eliminated.

The previous description and examples are to enable the person of skill to better understand the invention. The invention is not be limited by the description and examples but instead given a broad interpretation based on the claims to follow.

We claim:

1. A method for mining a narrow vein deposit of ore, the narrow vein deposit having a hanging wall and a foot wall, the method comprising:

drilling a pilot hole with a pilot hole diameter into the narrow vein deposit along a path substantially centrally between the hanging wall and the foot wall to a depth within the vein;

following the pilot hole with a hole opening drilling assembly having a diameter larger than the pilot hole diameter to fragment the ore around the pilot hole into drill cuttings;

circulating the drill cuttings with a fluid flow up to a wellhead; and collecting the drill cuttings for processing to recover the ore therefrom;

wherein drilling the pilot hole occurs with fluid circulation down through a pilot hole drilling assembly and up through the annulus, and wherein circulating the drill cuttings, during operation of the hole opening drilling assembly, includes pumping fluid in a reverse direction down through the annulus and up through the hole opening drilling assembly.

2. The method of claim 1 wherein drilling the pilot hole includes surveying the narrow vein deposit from the pilot hole to determine the pilot hole location relative to the hanging wall and the foot wall and directing a pilot hole drilling assembly to continue drilling substantially centrally between the hanging wall and the foot wall.

3. The method of claim 2 wherein surveying includes non-destructively imaging the narrow vein deposit about the pilot hole.

4. The method of claim 1 wherein following the pilot hole includes urging a stinger on a leading end of the hole opening drilling assembly through the pilot hole, the stinger including an outer diameter about the same or less than the pilot hole diameter.

5. The method of claim 1 wherein following the pilot hole proceeds while the pilot hole remains open hole.

6. The method of claim 1, wherein circulating the drill cuttings during operation of the hole opening drilling assembly uses a water-based fluid.

7. The method of claim 6, further comprising injecting compressed air at the hole opening drilling assembly to facilitate return of the water-based fluid.

8. The method of claim 1 further comprising increasing the fluid pressure above the hole opening drilling assembly when commencing operation of the hole opening drilling assembly near surface.

9. The method of claim 1 wherein the diameter of the hole opening drilling assembly is selected to substantially match the distance between the hanging wall and the foot wall and further comprising underreaming during operation of the hole opening drilling assembly to drill an enlarged diameter greater than the diameter.

10. A mining system for mining a narrow vein deposit of ore, the system comprising:

a drilling rig;

a pilot hole drilling assembly, including: a drill head for drilling a pilot hole in the ore, a downhole survey tool for locating a hanging wall and a foot wall of the narrow vein deposit relative to the pilot hole, and a directional assembly for directing the drill head along a path between the hanging wall and the foot wall, wherein the downhole survey tool is configured for extension through an opening in the drill head;

a hole opener assembly including an end configured to follow the pilot hole and a hole opener drill configured to drill a borehole with a larger diameter than the pilot hole to fragment the ore into drill cuttings; and a fluid circulation subsystem to move a fluid through the well to circulate the drill cuttings from the borehole to a well head.

11. The system of claim 10, wherein the downhole survey tool is a non-destructive imaging tool.

12. The system of claim 10 wherein the end of the hole opener assembly is a stinger having an outer diameter about the same or less than the pilot hole diameter.

13. The system of claim 10 wherein the fluid circulation subsystem is configured to forward circulate through the drill head and reverse circulate through the hole opening drilling assembly.

14. The system of claim 13, wherein the fluid circulation subsystem includes a conduit for injecting compressed air at the hole opening drilling assembly.

15. The system of claim 10 wherein the hole opener drill has a diameter selected to substantially match a distance between a hanging wall and a foot wall of the narrow vein deposit and the hole opener drill includes expandable underreamers operable to drill an enlarged diameter greater than the diameter.

16. The system of claim 10 further comprising a surface casing pipe having an inner diameter sufficient to accommodate passage of both the hole opener bit and the pilot hole drilling assembly.

17. The system of claim 16 further comprising a pipe housing with a diameter less than the inner diameter and large enough to accommodate an outer diameter of the pilot hole drilling assembly and the pipe housing is installed substantially co-axially within the casing pipe when the pilot hole drilling assembly is operating.

18. A mining system for mining a narrow vein deposit of ore, the system comprising:

a drilling rig;

a pilot hole drilling assembly including a drill head for drilling a pilot hole in the ore, a downhole survey tool for locating a hanging wall and a foot wall of the narrow vein deposit relative to the pilot hole, and a directional assembly for directing the drill head along a path between the hanging wall and the foot wall;

a hole opener assembly including an end configured to follow the pilot hole and a hole opener drill configured to drill a borehole with a larger diameter than the pilot hole to fragment the ore into drill cuttings; and a fluid circulation subsystem to move a fluid through the well to circulate the drill cuttings from the borehole to a well head, wherein the fluid circulation subsystem is configured to forward circulate through the drill head and reverse circulate through the hole opening drilling assembly.

19. The system of claim 18, wherein the downhole survey tool is configured for extension through an opening in the drill head and wherein the downhole survey tool is a non-destructive imaging tool.

20. The system of claim 18, wherein the fluid circulation subsystem includes a conduit for injecting compressed air at the hole opening drilling assembly.

21. The system of claim 18, wherein the hole opener drill has a diameter selected to substantially match a distance between a hanging wall and a foot wall of the narrow vein deposit and the hole opener drill includes expandable underreamers operable to drill an enlarged diameter greater than the diameter.

22. The system of claim 18, further comprising a surface casing pipe having an inner diameter sufficient to accommodate passage of both the hole opener bit and the pilot hole drilling assembly.

23. The system of claim 22, further comprising a pipe housing with a diameter less than the inner diameter and large enough to accommodate an outer diameter of the pilot hole drilling assembly and the pipe housing is installed substantially co-axially within the casing pipe when the pilot hole drilling assembly is operating.

24. A mining system for mining a narrow vein deposit of ore, the system comprising:

a drilling rig;

a pilot hole drilling assembly, including: a drill head for drilling a pilot hole in the ore, a downhole survey tool for locating a hanging wall and a foot wall of the narrow vein deposit relative to the pilot hole, and a directional assembly for directing the drill head along a path between the hanging wall and the foot wall;

a hole opener assembly including an end configured to follow the pilot hole and a hole opener drill configured to drill a borehole with a larger diameter than the pilot hole to fragment the ore into drill cuttings; and a fluid circulation subsystem to move a fluid through the well to circulate the drill cuttings from the borehole to a well head;

wherein the hole opener drill has a diameter selected to substantially match a distance between a hanging wall and a foot wall of the narrow vein deposit and the hole opener drill includes expandable underreamers operable to drill an enlarged diameter greater than the diameter.

25. The system of claim 24, wherein the downhole survey tool is configured for extension through an opening in the drill head and the downhole survey tool is a non-destructive imaging tool.

26. The system of claim 24, wherein the end of the hole opener assembly is a stinger having an outer diameter about the same or less than the pilot hole diameter.

27. The system of claim 24, wherein the fluid circulation subsystem is configured to forward circulate through the drill head and reverse circulate through the hole opening drilling assembly and the fluid circulation subsystem includes a conduit for injecting compressed air at the hole opening drilling assembly.

28. The system of claim 24, further comprising a surface casing pipe having an inner diameter sufficient to accommodate passage of both the hole opener bit and the pilot hole drilling assembly.

29. The system of claim 28, further comprising a pipe housing with a diameter less than the inner diameter and large enough to accommodate an outer diameter of the pilot hole drilling assembly and the pipe housing is installed substantially co-axially within the casing pipe when the pilot hole drilling assembly is operating.

* * * * *